US008490817B2

(12) United States Patent
Hamminga et al.

(10) Patent No.: US 8,490,817 B2
(45) Date of Patent: Jul. 23, 2013

(54) CONTAINER SEALING DEVICE

(76) Inventors: Lee Hamminga, Weldon Spring, MO (US); Kenneth P. Krohn, Oceanside, CA (US)

( * ) Notice: Subject to any disclaimer, the term of this patent is extended or adjusted under 35 U.S.C. 154(b) by 0 days.

(21) Appl. No.: 13/110,099

(22) Filed: May 18, 2011

(65) Prior Publication Data

US 2011/0284540 A1 Nov. 24, 2011

Related U.S. Application Data

(60) Provisional application No. 61/347,073, filed on May 21, 2010.

(51) Int. Cl.
*B65D 51/00* (2006.01)
*B65D 41/52* (2006.01)

(52) U.S. Cl.
USPC ..... 220/287; 220/266

(58) Field of Classification Search
USPC ..... 220/287, 359.4, 359.3, 359.2, 359.1, 220/268, 266, 265; 215/232, 258, 253, 250; 53/487, 488, 485
IPC ..... B65D 51/14,51/00, 41/54, 41/52, 41/32
See application file for complete search history.

(56) References Cited

U.S. PATENT DOCUMENTS 533,876 A * 2/1895 Ernst ..... 220/287
2,808,964 A 10/1957 Radtke
3,158,491 A * 11/1964 Farrell et al. ..... 426/122
3,550,835 A * 12/1970 Persson ..... 229/123.2
3,946,872 A * 3/1976 Sturm ..... 220/359.3
3,957,097 A 5/1976 Swett
4,170,316 A 10/1979 LaBarbera
4,187,953 A 2/1980 Turner
4,295,904 A * 10/1981 Schmit ..... 156/69
4,312,459 A 1/1982 Leach
4,433,800 A 2/1984 Owens
4,531,668 A * 7/1985 Forbes, Jr. ..... 229/123.2
4,693,390 A * 9/1987 Hekal ..... 220/270
RE32,927 E 5/1989 Taylor et al.
4,836,419 A 6/1989 Metz et al.
4,865,217 A * 9/1989 Yoshimoto ..... 220/266
5,054,642 A * 10/1991 Yoshida ..... 220/276
5,083,671 A 1/1992 Hayes
5,090,584 A * 2/1992 Roberts et al. ..... 220/712
5,125,528 A * 6/1992 Heyn et al. ..... 220/269
5,339,981 A 8/1994 Kral
5,392,949 A * 2/1995 McKenna ..... 220/712
5,452,818 A 9/1995 Yost
6,056,141 A * 5/2000 Navarini et al. ..... 220/269
7,097,076 B1 8/2006 Giblin et al.
7,216,779 B2 5/2007 Kasting et al.

(Continued)

*Primary Examiner* — Robert J Hicks

(57) ABSTRACT

The present invention generally relates to a device for sealing a container, and serves to alleviate disadvantages commonly associated with use of plastic wrap, cling wrap, and similar products. The device generally comprises a flexible sheet and sometimes a perimeter support member connected to the flexible sheet. The flexible sheet is positioned over and seals the opening of the container. The perimeter support member is then removed from the flexible sheet so that the support member does not interfere with use of the container. The flexible sheet may be comprised of more than one material, permitting the flexible sheet to adhere to the container while being compatible with the contents of the container. The device may also comprise a mechanical sealing mechanism, as well as an internal support structure. The device may be folded for storage and other purposes. The invention also includes methods of using and manufacturing the device.

21 Claims, 7 Drawing Sheets

U.S. PATENT DOCUMENTS

| | | | | |
|---|---|---|---|---|
| 7,353,973 | B2 | 4/2008 | Rohr | |
| 7,360,673 | B2 | 4/2008 | Abrahams | |
| 2001/0035414 | A1* | 11/2001 | Tyree | 220/229 |
| 2002/0056727 | A1 | 5/2002 | Brecheisen | |
| 2005/0150891 | A1* | 7/2005 | Schalk et al. | 220/266 |

* cited by examiner

FIG. 1A
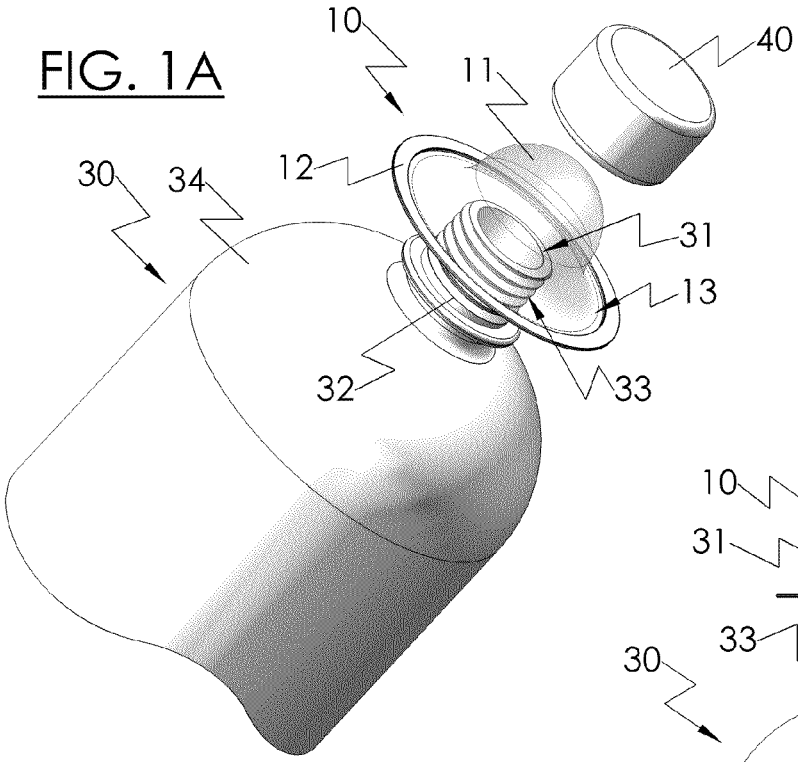
FIG. 1B
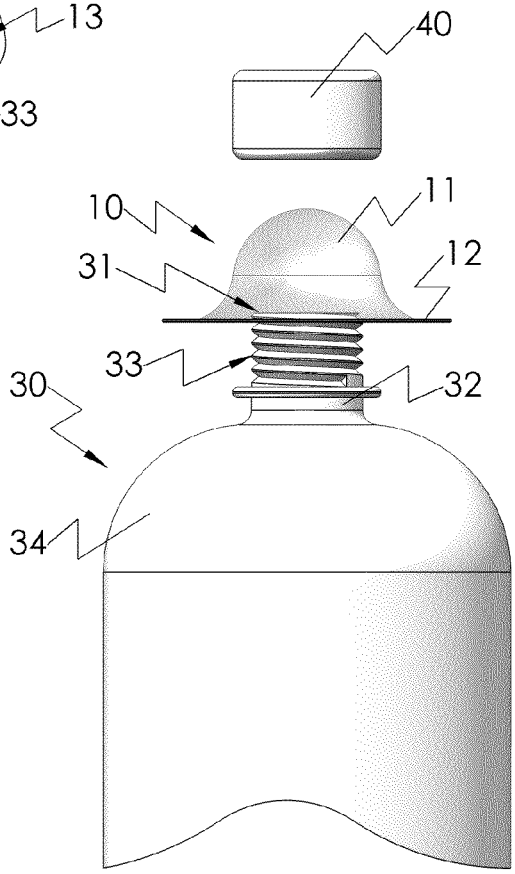
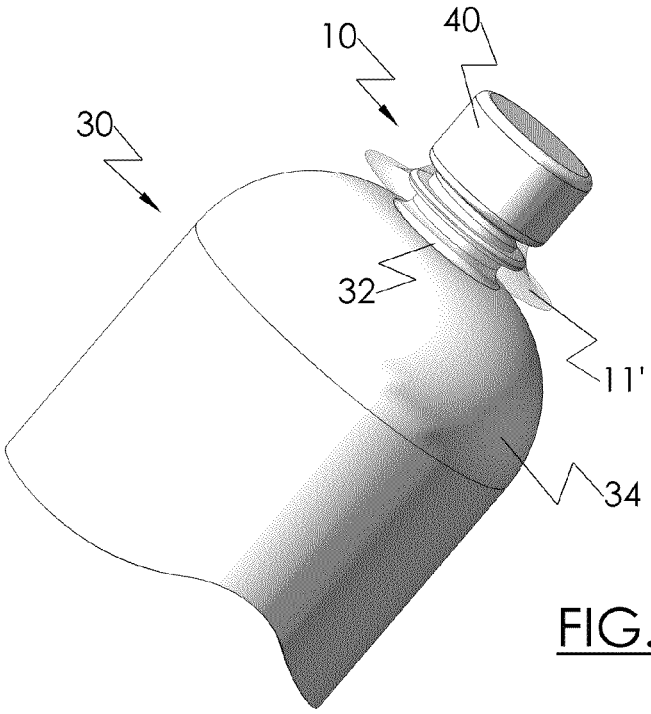
FIG. 1C

FIG. 5A
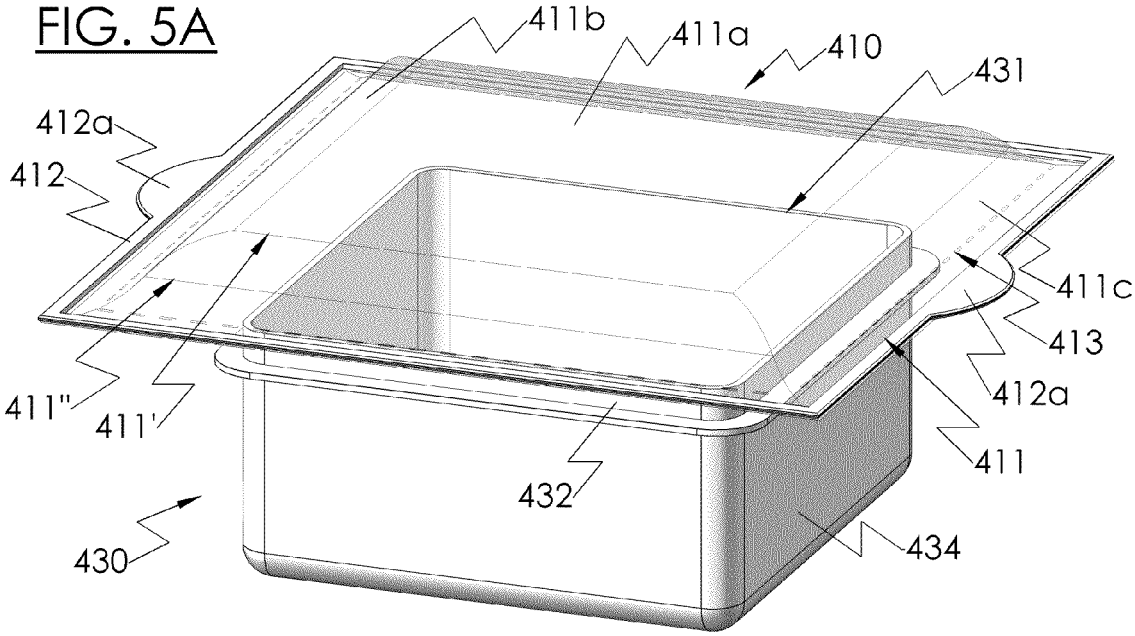
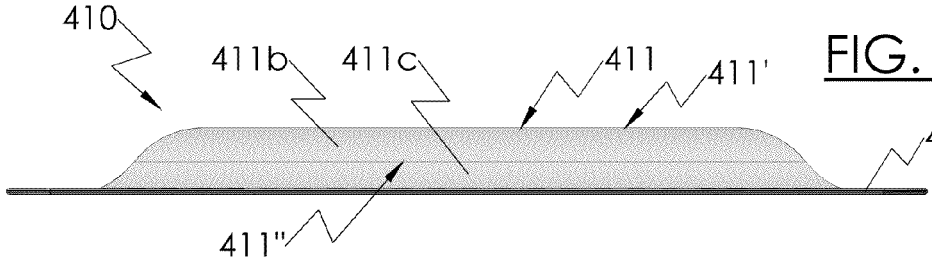
FIG. 5B
FIG. 6
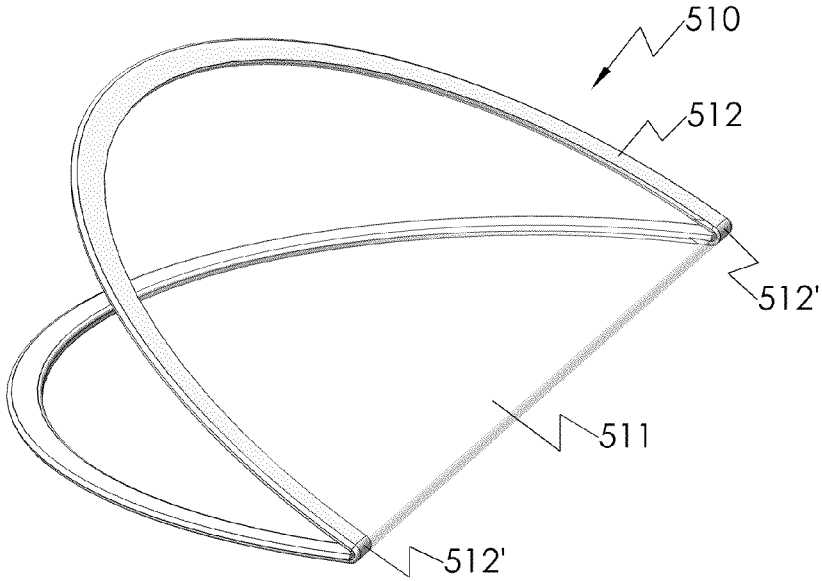

CONTAINER SEALING DEVICE

CROSS REFERENCES TO OTHER APPLICATIONS

This application claims the benefit of U.S. provisional application No. 61/347,073, filed on May 21, 2010, which is incorporated herein by reference. This application also incorporates by reference the entire disclosure of U.S. provisional application No. 61/263,755, filed on Nov. 23, 2009.

BACKGROUND

The present invention generally relates to a device that may be used to seal the opening of a container, as well as methods of use and manufacture related to the device. In various embodiments, the device may be used to seal containers having a spout or opening with a cap or lid adapted to be operatively connected to the spout or opening, respectively. In other embodiments, the device may be used to seal the opening of a container without utilizing a cap or lid.

Apparatus currently exist in the relevant art that may be used to seal the opening of a container. For example, the container may have a cap or lid that is connected to the container at the opening. Thus, a bottle with a threaded spout may have a cap with corresponding threads that may be rotated down onto the spout to prevent the contents of the bottle from spilling out through the spout. Alternatively, plastic ware that may be used to store food and other items may have a lid or top that is pressed down over the opening of the container. The geometries of the container surrounding the opening and the lid or top may be such that they interact to hold the lid or top in place relative to the container while the lid or top is connected to it. Again, the lid or top is designed to prevent spillage of the contents of the container through the opening of the container. In both of these cases, as well as other examples well known in the art that are not described herein, the seal between the container and its cap, lid or top may not be hermetic, so that fluids (gases or liquids) and certain solid materials (such as powers and granules) in the container may spill out the container opening even when the cap, lid or top is operatively connected to the container. In such instances, it may be necessary or desirable to position a flexible sheet of material, such as a thin sheet of plastic, between the container and its cap, lid or top to ensure the seal is adequate to retain the contents of the container. Sheets of this type of plastic material are well known in the art, and are often known as "plastic wrap," "cling wrap" or "glad wrap." Such products may be sold under the trademarks GLAD WRAP, GLAD PRESS'N SEAL, SARAN WRAP, SARAN PREMIUM WRAP, and STRETCH-TITE.

In other cases, the container may not have a corresponding cap, lid or top, or it may be more desirable to avoid using the cap, lid or top in certain instances, such as where the contents of the container exceed the capacity of the container with the cap, lid or top in place. In these cases, a flexible sheet of material may be used to seal the opening of the container without the use of a cap, lid or top. Thus, a thin sheet of plastic, such as plastic wrap, may also be positioned over the opening of the container in lieu of a cap, lid or top in order to seal the container opening.

In any case, when using thin sheets of plastic wrap, it is often inefficient, difficult and cumbersome to manipulate the plastic wrap into position over the opening of the container in order to provide a seal for the opening, as described above. For example, it is sometimes difficult to locate the end of the plastic wrap on the roll on which it is sold because of the transparent or consistent coloring of the plastic wrap. Even when the end can be located, it may be difficult to pull the end free from the remainder of the roll because of the clinginess, stickiness or tackiness that generally characterizes the plastic wrap. Further, when a portion of plastic wrap is pulled from the roll in order to be removed from it, the cutting mechanism designed to cut the portion of the roll to be removed is often ineffective. Rather than simply and easily cutting the material along the desired path, the mechanism often binds against the plastic wrap and causes the plastic wrap to bunch together in the direction of the cut. This is inconvenient because the plastic wrap, with its typical tackiness, is then difficult and time-consuming to straighten out again. Even if the cut is made as desired, the process of making the cut typically requires the use of both hands, which may present difficulty where use of both hands is not practical or convenient.

Even after the desired sheet of plastic wrap has been removed from the roll, static electricity, along with the clinginess, stickiness or tackiness of the wrap, may lead it to wrap around the hands or arms (or both) of the person using the sheet. Once again, the person using the material is then required to straighten it prior to use, which is often a cumbersome and difficult task, leading to wasted time and effort. If the plastic wrap becomes too tangled or bound, it may be necessary to discard it and start over again. In addition to being time-consuming and frustrating, this is also wasteful of natural resources. Even after moving the straightened plastic wrap to the container opening, it may be difficult to position the sheet of plastic wrap over the opening. For example, this task often takes both hands, and if one hand is not available (such as where it is necessary to hold the container with one hand), it may be difficult, time consuming and cumbersome to position the sheet over the opening without the sheet becoming tangled. There may also be cases where it is desirable for the plastic wrap to have some structure, such as one or more rigid members extending across the plastic wrap as it's positioned over a container opening. Thus, in covering a pie pan, the plastic wrap stretched over the pan could be held away from the pie, rather than sagging downward and contacting the pie's surface.

In addition, it may not always be convenient to utilize typical rolls of plastic wrap in all instances where it may be desirable to use plastic wrap. For example, if a person desires to use plastic wrap to seal containers while traveling, it is typically too cumbersome to carry a complete roll of plastic wrap along on the travels. If sheets are removed from the roll before the travel, they tend to tangle, making their use difficult and cumbersome. If two or more of such sheets are placed together, they not only tend to bind together, but to tangle as well, compounding the problem even more.

As a result, there is a need for a device that may be used to seal a container opening in a manner that avoids the problems described above. Thus, it would be advantageous to have a sealing device utilizing plastic wrap or another sealing sheet that can be easily removed from the packaging in which it is sold. A device that would avoid the need to cut and remove the sheet from a larger component would be particularly advantageous. A beneficial device would also prevent the plastic wrap or other sealing sheet from distorting its shape in a manner that would make its use unduly cumbersome. Therefore, the device would preferably prevent the plastic wrap or other sheet from distorting enough so that it wraps around the user's hands or arms or both. The device would also assist in conforming the plastic wrap or other sheet into the shape desired to position it over the opening of the container. The device may also incorporate some structure, so that it holds its position while covering the opening. Further, the device would be adapted to be of a size corresponding to the container or range of container sizes for which it is to be used. Further still, the device would be capable of being folded or otherwise compacted to minimize the volume required for its storage. Similarly, the geometry of the device would be such that multiple devices can be efficiently stacked together. These features would save available storage space and allow the user to conveniently carry the device while traveling. In addition, the preferred device would be capable of being adapted for use with different sizes and shapes of containers within a given range. It would also be desirable for the device to be disposable, as well as inexpensive and simple to manufacture.

There may also be concerns regarding the materials comprising the plastic wrap. For example, certain plastic materials may be less suitable for use with food than other plastic materials. Thus, plastic wrap constructed of a more clingy material may be desirable because the plastic wrap adheres better to the sides of the container, holding the wrap in place against the container, but the material may be less suitable for use with the contents of the container than other materials. In contrast, materials that may be more compatible with the container contents may be less clingy, so that the plastic wrap does not adhere to the container as well, and may fall away from the container rendering use of the plastic wrap impractical. As a result, there is a need for a device that seals a container opening with a material that is suitable for use with the contents of the container, while the device also provides for adequate adherence to the sides of the container.

SUMMARY

The present invention is directed to a device and methods of using and manufacturing the device that meet the needs discussed above in the Background section. As described in greater detail below, the present invention, when used for its intended purposes, has many advantages over other devices known in the art, as well as novel features that result in a new device and methods of using the device that are not anticipated, rendered obvious, suggested, or even implied by any prior art devices or methods, either alone or in any combination thereof.

In a preferred embodiment of the present invention, a device is disclosed for sealing the opening of a container. In this embodiment, the device is comprised of a flexible sheet and a perimeter support member connected to the flexible sheet. The flexible sheet is adapted to seal the opening of the container. The device may further comprise separation means (described in more detail below) adapted for operatively separating a portion of the flexible sheet from the remainder of the device, so that the separated portion of the flexible sheet is adapted to seal the container opening. In some embodiments, the separation means (described in more detail below) may be comprised of perforations extending around all or a portion of the perimeter of the separated portion of the flexible sheet. The flexible sheet may have a variety of different shapes in various embodiments, such as being approximately paraboloid, hemispherical or rectangular in shape. The perimeter support member may extend around the entire perimeter of the flexible sheet, but need not do so in all embodiments. The present invention also includes a method of manufacturing the device, the method comprising: (a) in any order, forming a flexible sheet and forming a perimeter support member, and (b) operatively attaching the perimeter support member to the flexible sheet.

In operating this device, the flexible sheet may be positioned over the opening of the container. If the container has a cap that may be operatively connected to the container, the cap may then be placed over the opening of the container and the flexible sheet. As the cap is operatively connected to the container, the flexible sheet is deformed to conform to the surface of the container adjacent to the opening and the surface of the cap, thereby tending to fill the space between the cap and the container. As a result, the opening of the container is adapted to be operatively sealed, and a seal is adapted to be formed between the container opening and the cap, so that the contents of the container do not spill out through the opening of the container when the container is oriented in various positions (such as upside down). The device may also be used without the cap, so that the flexible sheet may be positioned over the opening of the container, pulled tightly against the surfaces of the container adjacent to the opening, and then pressed together and against the exterior surface of the container adjacent to the opening, as is common with use of plastic wrap. The perimeter support member, which may provide structural support for the flexible sheet while it is being positioned relative to the container and the cap, may then be pulled away from the opening and cap so that the separated portion of the flexible sheet is pulled taut between the container opening and cap, on the one hand, and the perimeter support member on the other, so that the separated portion of the flexible sheet is separated from the remainder of the device.

In another embodiment, a device of the present invention comprises a flexible sheet, a support member, and sheet connecting means (described in more detail below) for connecting the flexible sheet to the support member. The flexible sheet of the device is adapted to be positioned over a container opening in a manner that seals the opening, and the support member is adapted to be removed from a separable portion of the flexible sheet that is positioned over the container opening. In yet another embodiment, a device provides a seal between a container spout and a cap adapted to be operatively connected to the container spout. In this embodiment, the device comprises a flexible sheet and a support member attached to the flexible sheet approximately at the perimeter of the flexible sheet. The flexible sheet is adapted to be positioned between and to form a seal between the container spout and the cap while the cap is operatively connected to the container spout. In still another embodiment, a device of the present invention is disclosed for sealing a container opening, wherein the device comprises a flexible sheet, a support member attached to the flexible sheet approximately around the perimeter of the flexible sheet, and separation means (described in more detail below) adapted for operatively separating a portion of the flexible sheet from the remainder of the device so that the separated portion of the flexible sheet is adapted to seal the container opening.

In another embodiment, a device is adapted to be positioned over the opening of a container to seal the opening, and the device comprises a flexible sheet and perimeter support means (described in more detail below) for providing structural support for the flexible sheet. The perimeter support means (described in more detail below) are adapted to be removed from a portion of the flexible sheet after the flexible sheet is positioned over the opening. In yet another embodiment, a device for sealing the opening of a container is disclosed, the device comprising a flexible sheet and a perimeter support member connected to the flexible sheet. The flexible sheet is adapted to seal the opening and the device is adapted to be folded or compacted for storage.

In yet another embodiment, a device of the present invention comprises a flexible sheet and a perimeter support member connected to the flexible sheet. A separable portion of the flexible sheet is adapted to be separated from the remainder of the device and to be positioned over the opening. The perimeter support member is a part of the remainder of the device adapted to be separated from the separable portion of the flexible sheet. As described in more detail below, the device may also further comprise: (a) separation means adapted for operatively separating the separable portion of the flexible sheet from the remainder of the device (which may be comprised of perforations extending around all or a portion of the perimeter of the separable portion); (b) an internal support structure (which may be comprised of a plurality of rigid or semi-rigid members extending along the flexible sheet); and (c) supplemental sealing means (described in more detail below) adapted for enhancing operative sealing of the separable portion of the flexible sheet to the container.

In still another embodiment, a device of the present invention for sealing a container opening is comprised of a flexible sheet (which is further comprised of a polymer material), a support member connected to the flexible sheet at approximately the perimeter of the flexible sheet, and separation means (described in more detail below) adapted for operatively separating a portion of the flexible sheet from the remainder of the device so that the separated portion of the flexible sheet is adapted to seal the container opening. The device may also be further comprised of folding means (described in more detail below) for adapting the device to be folded. A method of manufacturing the device may comprise: (a) in any order, forming the flexible sheet and forming the support member; and (b) operatively attaching the support member to the flexible sheet. The device may also further comprise an internal support structure or a layer of material positioned on a surface of the flexible sheet, or both.

In other embodiments, a device of the present invention may comprise a flexible plastic sheet having an interior portion and an exterior portion. The interior portion may be comprised of a first material and at least a part of the interior portion is adapted to be positioned over and to seal an opening of a container. The exterior portion extends around all or a portion of the perimeter of the interior portion and may be comprised of a second material adapted to adhere to itself and to the portions of the container adjacent to the opening. The device may further comprise perimeter support means (described in more detail below) for providing structural support for the device, wherein the perimeter support means are adapted to be removed from a separable portion of the flexible plastic sheet that is adapted for use in operatively sealing the container opening. In different variations, the exterior portion may extend around the entire perimeter of the interior portion, the device may further comprise a layer of a third material positioned on a surface of the flexible plastic sheet, any portion of the interior portion may have a thickness that is different from the thickness of any portion of the exterior portion of the flexible plastic sheet, the device may further comprise an internal support structure comprised of a plurality of rigid or semi-rigid members extending along the flexible plastic sheet, and the flexible plastic sheet may further comprise a middle portion, which is further comprised of a third material and is positioned between the interior portion and the exterior portion of the flexible plastic sheet.

In another embodiment, a device of the present invention for sealing an opening of a container comprises a flexible plastic sheet and a layer of material positioned on a surface of an interior portion of the flexible plastic sheet. The flexible plastic sheet is further comprised of the interior portion, at least a portion of which is adapted to be positioned over the opening, and a peripheral portion, wherein at least a portion of the peripheral portion is adapted to be positioned adjacent to the container. The device may further comprise a perimeter support member connected to the flexible sheet, wherein a separable portion of the flexible plastic sheet is adapted to be separated from the perimeter support member and adapted to seal the container opening. In different variations, the interior portion and the peripheral portion may be comprised of the same material, and the layer of material may be adapted to be compatible with the contents of the container. The layer of material may also be positioned on the interior portion of the flexible plastic sheet as an aerosol spray or a vapor. In other variations, the peripheral portion may extend around the entire perimeter of the interior portion, and the flexible plastic sheet may further comprise a middle portion, which may be comprised of a material different from the material comprising the peripheral portion and may be positioned between the interior portion and the peripheral portion. The device may also further comprise a second layer of material, wherein the flexible plastic sheet further comprises a middle portion positioned between the interior portion and the peripheral portion, and the second layer of material is positioned on a surface of the middle portion.

In still another embodiment, a device of the present invention for sealing the opening of a container may comprise a flexible plastic sheet and a layer of material positioned on a surface of a peripheral portion of the flexible sheet. The flexible plastic sheet is further comprised of an interior portion, at least a portion of which is adapted to be positioned over the opening, and the peripheral portion, at least a portion of which is adapted to be positioned adjacent to the container. The device may further comprise a perimeter support member connected to the flexible sheet, and a separable portion of the flexible plastic sheet may be adapted to be separated from the remainder of the device, which remainder is comprised of the perimeter support member. In different variations, the layer of material may be comprised of an adhesive and be positioned on the surface of the flexible plastic sheet adapted to face the container. The interior portion of the flexible plastic sheet may also be comprised of a material adapted to be compatible with the contents of the container. The device may also further comprise perimeter support means (described in more detail below) for providing structural support for the device and separation means (also described in more detail below) for removing a separable portion of the flexible plastic sheet from the remainder of the device. Further, the device may be comprised of a plurality of peripheral portions, and at least a portion of each peripheral portion may be adapted to be positioned adjacent to the container. The peripheral portion may also extend around the entire perimeter of the interior portion. The device may further comprise a second layer of material, wherein the flexible plastic sheet further comprises a middle portion positioned between the interior portion and the peripheral portion, and the second layer of material is positioned on a surface of the middle portion. The flexible plastic sheet may also further comprise a middle portion, which is comprised of a material different from the material comprising the peripheral portion and is positioned between the interior portion and the peripheral portion.

In yet other embodiments, a device of the present invention for sealing the opening of a container is comprised of a flexible sheet, at least a portion of which is comprised of a plastic film and adapted to seal the opening, a perimeter support member positioned approximately at the perimeter of the flexible sheet, and mechanical sealing means (described in more detail below) adapted for assisting the flexible sheet in sealing the container opening. The device may further comprise separation means (described in more detail below) adapted for operatively separating a separable portion of the flexible sheet from the remainder of the device, wherein the separable portion of the flexible sheet is adapted to seal the container opening. In different variations, the separation means (described in more detail below) may be comprised of perforations extending around all or a portion of the perimeter of the separable portion of the flexible sheet, and the mechanical sealing means (described in more detail below) may be comprised of a drawstring mechanism positioned approximately at the perimeter of the flexible sheet.

In another embodiment, a device of the present invention for sealing the opening of a container comprises a flexible sheet comprised of a plastic film, a perimeter support member connected to the flexible sheet, and supplemental sealing means (described in more detail below) adapted for enhancing operative sealing of a portion of the separable portion of the flexible sheet to the portion of the container adjacent to the opening. A separable portion of the flexible sheet is adapted to be separated from the remainder of the device and to be positioned over and seal the opening, while the perimeter support member is adapted to be separated from the separable portion of the flexible sheet. The device may also further comprise separation means (described in more detail below) adapted for operatively separating the separable portion of the flexible sheet from the remainder of the device. In different variations, the supplemental sealing means (described in more detail below) may comprise the flexible sheet being further comprised of an interior portion adapted to be positioned over the opening and an exterior portion surrounding the interior portion, and the exterior portion may be comprised of a material more adapted to adhere to the portion of the container adjacent to the opening than the material comprising the interior portion of the flexible sheet. The material comprising the exterior portion may be further comprised of an adhesive. Also, the supplemental sealing means (described in more detail below) may be comprised of a mechanical sealing mechanism. Further, the supplemental sealing means (described in more detail below) may be further comprised of the flexible sheet comprising a first layer of material and a second layer of material positioned on the first layer. The first layer of material has an interior portion, at least a portion of which is adapted to be positioned over the opening, and a peripheral portion, wherein at least a portion of the peripheral portion is adapted to be positioned adjacent to the container. The second layer of material is positioned on the first layer within the peripheral portion of the flexible sheet, and the second layer of material is adapted to adhere to the container. The peripheral portion may extend around the entire perimeter of the interior portion of the flexible sheet in some variations. The supplemental sealing means (described in more detail below) may also be further comprised of the second layer of material being positioned on the first layer within the interior portion of the flexible sheet, wherein the second layer of material is adapted to be compatible with the contents of the container. The peripheral portion may also extend around the entire perimeter of the interior portion of the flexible sheet in this variation as well. In addition, the second layer of material may be comprised of an antimicrobial material.

In still other embodiments, a device of the present invention for sealing the opening of a container comprises a flexible sheet, a perimeter support member connected to the flexible sheet, and internal support means (described in more detail below) for assisting in operatively holding the separable portion of the flexible sheet operatively in place. The flexible sheet is comprised of a plastic film, and a separable portion of the flexible sheet is adapted to be separated from the remainder of the device and to be positioned over and seal the opening. In addition, the perimeter support member is adapted to be separated from the separable portion of the flexible sheet. The device may also further comprise separation means (described in more detail below) adapted for operatively separating the separable portion of the flexible sheet from the remainder of the device. In other variations, the internal support means (described in more detail below) may be comprised of a plurality of rigid or semi-rigid members extending along the flexible sheet, and the plurality of rigid or semi-rigid members may extend along a surface of the flexible sheet in some variations. The perimeter support member may also be approximately annular in shape and the plurality of rigid or semi-rigid members may be comprised of an annular member and a radial member.

In another embodiment, a device of the present invention for sealing the opening of a container comprises a flexible sheet and a layer of material adapted to adhere to itself and the container, which layer of material is positioned on the surface of the flexible sheet adapted to face the container. The flexible sheet is comprised of a plastic film, and a separable portion of the flexible sheet is adapted to be separated from the remainder of the device and to be positioned over and seal the opening. The separable portion of the flexible sheet is further comprised of a peripheral portion that is adapted to be positioned against the container, and the layer of material is positioned within the peripheral portion. In different variations, the layer of material may be comprised of an adhesive or another material that has a higher degree of clinginess than the material comprising the flexible sheet. In addition, the separable portion may be comprised of a plurality of peripheral portions, and at least a portion of each peripheral portion may be adapted to be positioned adjacent to the container. The plurality of peripheral portions may have the shape illustrated in FIG. 11. Further, the peripheral portion may extend around the entire perimeter of the separable portion in some variations. A method of manufacturing the device comprises depositing the layer of material on the flexible sheet.

As may be noted from the preceding summary of preferred embodiments of the present invention, and the following general summary and detailed description, the device of the present invention meets the needs discussed above in the Background section. For example, the device may be adapted to be of a size corresponding to the container for which it is to be used. The device may also be capable of being adapted for use with different sizes and shapes of containers within a given range. Further, the device may also be capable of being folded or otherwise compacted to minimize the volume required for its storage. Similarly, the geometry of the device may be such that multiple devices can be efficiently stacked together. These features may save available storage space and allow the user to conveniently carry the device while traveling. The device may also be adapted to be disposable because it is inexpensive and simple to manufacture.

As another example, the sealing device of the present invention utilizes a flexible sheet that can be easily removed from the packaging in which it is sold. There is no longer any need to locate the end of a flexible sheet on the roll because the devices, which may be stacked on one another for storage, can be easily separated and removed from one another. Similarly, there is no longer any need to cut a portion of flexible sheet from a roll in order to remove the desired portion from the roll. Because no cutting is involved, there is no bunching of the material comprising the flexible sheet, and no time wasted in straightening out the bunched sheet. And there is no longer any need to use two hands to ready the sheet for use in many instances. Because the support member holds the flexible sheet in position, the flexible sheet does not ordinarily wrap around the hands or arms (or both) of the person using the sheet. This reduces time required to straighten the sheet prior to use, the frustration associated with such straightening, and the waste involved in discarding the sheet if it becomes too tangled or bound.

Further, because the support member holds the flexible sheet in position, the device is efficiently and easily positioned over the opening of the container to provide a seal for the opening. The device also assists in conforming the flexible sheet into the shape desired to seal it over the opening of the container. The support member also holds the flexible sheet in position while any cap or lid is positioned over the flexible sheet and the opening of the container. Once the flexible sheet is in the desired position, the support member (and any attached portion of the flexible sheet) can be easily removed from the separated portion of the flexible sheet that is used to seal the container opening. An internal support structure incorporated in the device may also be used to assist in holding the separated portion of the flexible sheet in place relative to the container and its opening. Thus, the device of the present invention provides all of the functions desired in a single device.

Further still, the device may be comprised of more than one different type of material where it may be more advantageous to have one material cover the opening of the container and another material, which may have more clinginess than the first material, adapted to adhere to the sides of the container, assisting in holding the plastic wrap in place over the container opening. In other embodiments, the device may comprise different layers of materials or coatings that may be used to enhance the seal between the device and the sides of the container. In some embodiments, use of perimeter support means (described in more detail below) may not be utilized.

There has thus been outlined, rather broadly, the more primary features of the present invention. There are additional features that are also included in the various embodiments of the invention that are described hereinafter and that form the subject matter of the claims appended hereto. In this respect, it is to be understood that the invention is not limited in its application to the details of construction and to the arrangements of the components set forth in the following description or illustrated in the following drawings. This invention may be embodied in the form illustrated in the accompanying drawings, but the drawings are illustrative only and changes may be made in the specific construction illustrated and described within the scope of the appended claims. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

The foregoing summary, as well as the following description, will be better understood when read in conjunction with the appended drawings, in which:

FIG. 1A is a perspective view of an embodiment of a device of the present invention, as viewed from the side of and above the device and a container, the opening of which the device is adapted to seal.

FIG. 1B is an elevation view of the embodiment of the device illustrated in FIG. 1A, as viewed from the side of the device and the container.

FIG. 1C is a perspective view of the embodiment of the device illustrated in FIG. 1A and FIG. 1B, as viewed from the side of and above the device and the container, wherein a separated portion of the flexible sheet is positioned between the opening and the cap of the container and the remainder portion of the device (not illustrated) is removed from the separated portion of the sheet.

FIG. 5A is a perspective view of yet another embodiment of a device of the present invention, as viewed from the side of and above the device and a container, the opening of which the device is adapted to seal.

FIG. 5B is an elevation view of the embodiment of the device illustrated in FIG. 5A, as viewed from the side of the device.

FIG. 6 is a perspective view of yet another embodiment of a device of the present invention, as viewed from the side of and above the device.

DETAILED DESCRIPTION

Figure 2A:
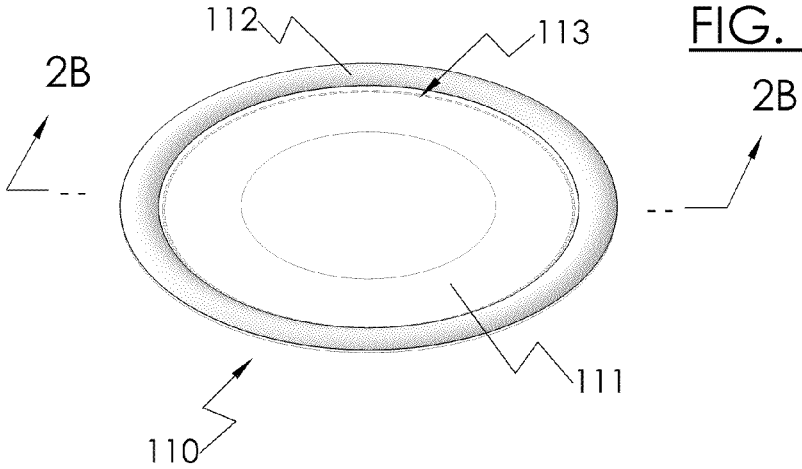
FIG. 2A is a perspective view of another embodiment of a device of the present invention, as viewed from the side of and above the device.

Reference will now be made in detail to the preferred aspects, versions, variations and embodiments of the present invention, examples of which are illustrated in the accompanying drawings. While the invention will be described in conjunction with the preferred aspects, versions and embodiments, it is to be noted that the aspects, versions, variations and embodiments are not intended to limit the invention to those aspects, versions, variations' and embodiments. On the contrary, the invention is intended to cover alternatives, modifications, portions and equivalents, which may be included within the spirit and scope of the invention as defined by the appended claims.

One embodiment of the present invention is the device 10 illustrated in FIG. 1A through FIG. 1C. The device 10 may be used for sealing the opening 31 of a container 30, wherein the container 30 also has a cap 40 that is adapted to be operatively connected to the container 30 at the spout 32 of the container 30. The device 10 of this embodiment is generally comprised of a flexible sheet 11, perimeter support means (perimeter support member 12 in this embodiment), sheet connecting means (not illustrated), and separation means (perforations 13 in this embodiment), all as described in more detail below. The flexible sheet 11 is adapted to be positioned over the opening 31 between the cap 40 and the spout 32, and is thereby adapted to form a seal between the cap 40 and the spout 32, also sealing the opening 31 of the container 30, as described in more detail below. In various embodiments, the device 10 may be adapted for use with a particular size and shape of container 30 or it 10 may (which is preferred in most applications) be adapted for use with containers 30 having a variety of different shapes and sizes within a predetermined range. It is to be noted that the device 10 may or may not comprise the perimeter support means (perimeter support member 12) or separation means (perforations 13) in various embodiments. In other embodiments, the present invention may also comprise the device 10 and the container 30 or the cap 40 or both of them 30, 40. It is also to be noted that the flexible sheet 11 illustrated in FIG. 1A through FIG. 1C has a relatively high degree of transparency, so that it is generally possible to see through it 11. In other embodiments, the flexible sheet 11 may have a higher or lesser degree of transparency, may be entirely or partially opaque, may be comprised of one or more colors, and may have different combinations of optical properties comprising different portions of the flexible sheet 11.

Figure 4A:
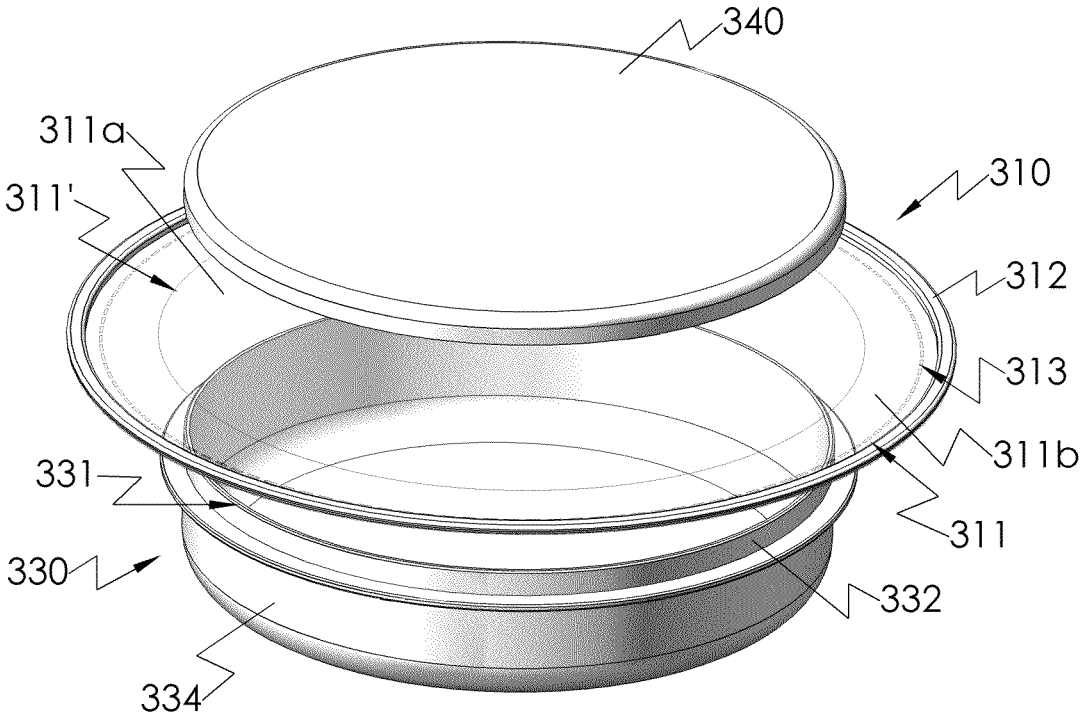
FIG. 4A is a perspective view of another embodiment of a device of the present invention, as viewed from the side of and above the device and a container, the opening of which the device is adapted to seal.

Referring to the device 10 of FIG. 1A through FIG. 1C as an example, the present invention (device 10) may be used with a wide variety of containers 30 and their corresponding caps 40. For example, the container 30 and cap 40 may be comprised of a bottle, canister, can, cask, box, bag, carton, carafe, hopper, pouch, package, packet, sack, vial, flask, jar, jug, tank, vat, vessel or other container. Thus, the container 30 may be in the form of a bottle having a spout 32 that is generally smaller than the portion 34 of the container 30 designed to hold the contents. In such cases, as illustrated in container 30, the spout 32 may have threads 33 that correspond to internal threads (not illustrated) in the cap 40, so that the cap 40 is operatively connected to the container 30 spout 32 by rotating the cap 40 onto the spout 32. In other cases, the container 30 spout 32 may not have threads 33, so that the cap 40 is operatively connected to the spout 32 by another means, such as by complimenting geometries of the spout 32 and cap 40 that tend to hold the cap 40 in place relative the spout 32, but in which the cap 40 can be removed by exerting sufficient force on the cap 40 (such as longitudinally along the container 30) to pull the cap 40 from the spout 32. In yet other cases, the container 30 may not have what would ordinarily be referred to as a spout 32, but may still utilize a threaded connection with its corresponding cap 40. For example, the container 30 may be in the form of a jar (not illustrated), which has an opening 31 of a size similar to the remaining portion 34 of the container 30, with threads 33 around the exterior surface adjacent to the opening 31, such threads 33 corresponding to interior threads in a cap 40 designed to be operatively connected to the jar. In still other cases, the container 30 and its cap 40 may have the form of the container 330 and cap 340, respectively, that may be used with the device 310, all as illustrated in FIG. 4A. In this case, the container 330 may generally tend to have a diameter greater than that of the container 30 and a length less than that of container 30. The opening 331 of the container 330 may also generally be of a size similar to the remaining portion 334 of the container 330, but this need not be so in all cases. The portion 332 of the container 330 adjacent to the opening 331 may have a geometry that cooperates with the geometry of the cap 340 to permit the cap 340 to be operatively connected to the container 330. Alternatively, the portion 332 of the container 330 adjacent to the opening 331 may have threads (not illustrated) that correspond to threads (not illustrated) on the cap 340, so that the cap 340 is operatively connected to the container 330 by rotating the cap 340 onto such portion 332 of the container 330. In other cases, and referring to the container 430 that may be used with the device 410 as an example, all as illustrated in FIG. 5A, the container 430, its opening 431, and the portion 432 of the container (or spout) adjacent to the opening 431 may have almost any shape. In the illustrated case, the container 430 is approximately square in shape. In other cases, the container 430 and its various portions 432, 434, as well as any cap (not illustrated) that may cooperate with the container 330, may each or all be approximately elliptical, triangular, rectangular, pentagonal, another polygonal shape, other shapes having arcuate or linear portions, or another shape or combination of such shapes.

Generally, and referring again to the device 10 of FIG. 1A through FIG. 1C as an example, the container 30 and any cooperating cap 40 may be comprised of almost any type of container and cap, respectively, currently known in the relevant art or that may be developed in the relevant art in the future, as long as the flexible sheet 11 is capable of being operatively positioned between the container 30 and any cooperating cap 40 or over the opening 31 of the container 30, all as described in more detail below. In addition, the device 10 of the present invention may be used in various embodiments to provide a seal between the container 30 and the cap 40, or may be used to seal the opening 31 of the container 30 without the presence of a cap 40, or may be used to seal the opening 31 of the container 30 with the presence of a cap 40. The preferred size and shape of the container 30 and any cooperating cap 40 are dependent upon a number of factors, such as the anticipated use of the container 30 and the preferences of the user of the container 30. The container 30 and any cooperating cap 40 may be comprised of any suitable type of material. For example, the container 30 and any cooperating cap 40 may be comprised of metal (such as steel, steel alloys, aluminum, copper, brass, or other metals or metal alloys), polymers (such as PVC, polyethylene, polypropylene, ABS, and other polymers), wood, glass, fiberglass, carbon-based or other composites, paper, ceramic, or other materials or a combination of any such materials. In addition, the container 30 and any cooperating cap 40 may be comprised of the same material, or different materials. The preferred material is dependent upon a number of factors, such as the anticipated use of the container 30 and cap 40 and the preferences of the user of the container 30 and cap 40. The container 30 and any cooperating cap 40 may be fabricated using any suitable means. For example, a container 30 and any cooperating cap 40 constructed of a polymer may be formed by blow molding or injection molding or both. It is to be noted that references to a "cap" (such as cap 40, and lids 340, 440)

herein are generally intended to include caps, lids, tops, and other enclosing or covering mechanisms or means that may be used to seal openings in containers, all as currently known in the relevant art or that may be developed in the relevant art in the future.

The flexible sheet 11 of the device 10 may generally be comprised of any material or combination of materials that permit the flexible sheet 11 to be operatively positioned over the opening 31 of the container 30, and between the container spout 32 and the cap 40 where a cap 40 is utilized, and that is adapted to provide the desired sealing of the opening 31 of the container 30, preferably preventing the contents of the container 30 from spilling out through the opening 31 of the container 30 in anticipated operating conditions. For example, the flexible sheet 11 may be comprised of any material that may be used in products commonly referred to as plastic wrap, cling film, or cling wrap. Such products may be sold under the trademarks GLAD WRAP, GLAD PRESS'N SEAL, SARAN WRAP, SARAN PREMIUM WRAP, and STRETCH-TITE. Thus, the flexible sheet 11 may be comprised of films or sheets of plastic or polymer materials, such as polyvinyl chloride (PVC), polyvinylidene chloride (PVdC), low density polyethylene (LDPE), linear low density polyethylene (LLDPE), or a combination of such materials, or any other suitable material or materials currently known in the relevant art or that may be developed in the relevant art in the future. Plastic and polymer films and sheets may also comprise wax, paraffin or other similar materials. An example is the plastic film sold by Pechiney Plastic Packaging under the trademark PARAFILM. Plastic and polymer films and sheets may also be predominately comprised of a plastic or polymer material, but may further comprise non-plastic or non-polymer materials. Where PVC is utilized, it may also include plasticizers, such as polymerized plasticizers or bis(2-ethylhexyl) adipate. In some embodiments, it is also preferred that the flexible sheet 11 possess properties that produce a "clinginess," "stickiness" or "tackiness" so that the flexible sheet 11 tends to adhere to itself and the container 30 and cap 40 when operatively in position on the container 30 and the cap 40 (in embodiments where the cap 40 is utilized). The flexible sheet 11 need not, however, possess such clinginess, stickiness or tackiness in all embodiments. Materials such as PVC may possess sufficient clinginess on their own, without more. Other materials, such as natural polymers of LDPE and PVdC, may not be sufficiently clingy on their own. To achieve the desired clinginess in such embodiments, polymers with lower molecular weight, such as polyisobutene, and poly[ethylene-vinylacetate], may be added. Alternatively, an adhesive, such as an edible gum, may be present on a surface of the flexible sheet 11 to provide tackiness or clinginess. In such embodiments, the surface of the flexible sheet 11 may be covered by shaped dimples (not illustrated), which hold the adhesive away from the surface. While the flexible sheet 11 is being handled, it is generally unsticky, but when pressure is applied to the flexible sheet 11 the dimples are flattened and the adhesive pushed against the contacting surface, sticking them together. The preferred material for the flexible sheet 11 is dependent upon a number of factors, such as the contents of the container 30, the anticipated operating conditions of the device 10 (such as temperature, pressure, etc.), the desired characteristics of the seal over the opening 31 of the container 30, environmental considerations, and other factors. For example, PVC generally has better sealing and adhering properties than LDPE, but may also present greater ancillary concerns than LDPE for certain uses. The thickness of the flexible sheet 11 is also dependent upon a number of factors, such as the operating conditions of the device 10, the geometry of and materials comprising the container 30, the contents of the container 30, the desired characteristics of the seal over the opening 31 of the container 30, and other factors. For general household use, the thickness of the flexible sheet is preferably approximately 0.02 mm (0.0008 20 inches). The flexible sheet 11 also preferably possesses enough clinginess to provide adequate adherence to itself 11 and to the sides of the container 30 (around the spout 32) to operatively hold the flexible sheet 11 in place relative to the container 30.

The flexible sheet 11 of the device 10 may also generally have any shape or combination of shapes so that it cooperates with the perimeter support means (perimeter support member 12 in this embodiment), as described in more detail below, and may be positioned over the opening 31 of the container 30 so that it is adapted to operatively seal the opening 31, preferably so that the contents of the container 30 do not spill out through the opening 31 in anticipated operating conditions. For example, as best illustrated in FIG. 1A and FIG. 1B, the flexible sheet 11 may be approximately paraboloid in shape. In this embodiment, the shape of the flexible sheet 11 allows it to be placed over the opening 31 of the container 31 and have sufficient surface area to conform to the grooves between the threads 33 of the spout 32 and the cap 40. Thus, in operation, the flexible sheet 11 of the device 10 is positioned over the opening 31 of the container 30, and the cap 40 is then placed over the spout 32 and the flexible sheet 11. As the cap 40 is rotated down onto the spout 32, the flexible sheet 11 is deformed to conform to the exterior surface of the spout 32 and the interior surface of the cap 40, thereby tending to fill the space between the cap 40 and spout 32 within the overlapping threads 33 of the spout 32 and the cap 40. As a result, the opening 31 of the container 30 is adapted to be operatively sealed, and a seal is adapted to be formed between the container opening 31 and the cap 40, so that the contents of the container 30 preferably do not spill out through the opening 31 of the container 40 when the container 30 is oriented in various positions (such as upside down) in which the contents might ordinarily leak through the space between the spout 32 and cap 40. It is to be noted that the contents of the container 30 in this embodiment are typically (but need not always be) fluids or other materials, such as powders or granulated materials, that may have flow properties similar to fluids.

Figure 3A:
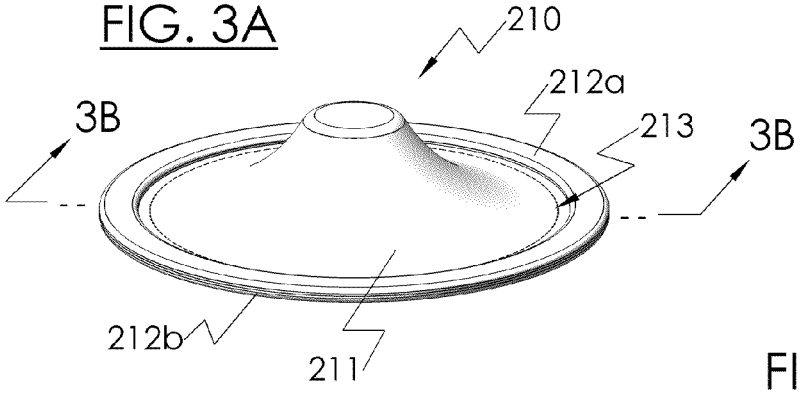
FIG. 3A is a perspective view of another embodiment of a device of the present invention, as viewed from the side of and above the device.
Figure 4B:
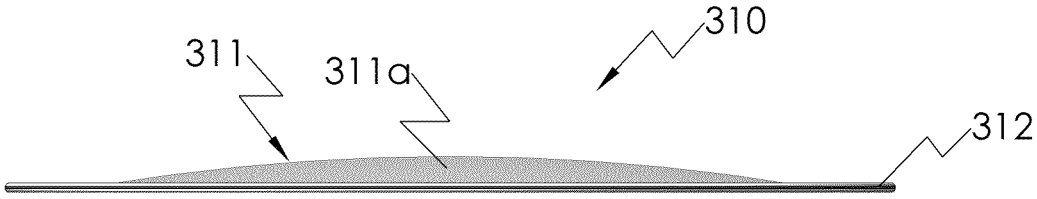
FIG. 4B is an elevation view of the embodiment of the device illustrated in FIG. 4A, as viewed from the side of the device.

In other embodiments, the flexible sheet 11 may have different shapes or combinations of shapes. For example, in the devices 110 and 310, as best illustrated in FIG. 2A and FIG. 4B, respectively, the flexible sheets 111, 311, respectively, may have an approximately convex or concave shape. Referring to the device 310 illustrated in FIG. 4A as an example, these shapes may be more preferred in cases where the device 310 is utilized to seal the opening 331 of a container 330 without the cap 340 being present, or to operatively seal the opening 331 of a container 330 where the container 330 and the cap 340 utilize a relatively simple connecting geometry other than threads. As another example, in the device 210 best illustrated in FIG. 3A, the flexible sheet 211 may be approximately paraboloid in shape, but with a flattened apex. As yet another example, in the device 410 illustrated in FIG. 5A and FIG. 5B, the flexible sheet 411 may be approximately square or rectangular in shape. In this embodiment, the flexible sheet 411 is square when viewed from above the device 410, as best illustrated in FIG. 5A, and also has a sectional shape that is approximately rectangular when viewed from the side of the device 410, as best illustrated in FIG. 5B. As still another example, in the device 1210 illustrated in FIG. 13A and FIG. 13B, the flexible sheet 1211 may have a shape that is approximately hemispherical.

Referring to the device 410 illustrated in FIG. 5A and FIG. 5B as an example, it is to be noted that various sectional profiles may be combined with various profiles, as viewed from above the device 410. For example, the flexible sheet 411 may have a square shape when viewed from above the device 410, but rise to form an approximately paraboloid apex similar to that of the flexible sheet 11 illustrated in FIG. 1A through FIG. 1C. Similarly, and referring again to the device 10 illustrated in FIG. 1A through FIG. 1C as an example, the flexible sheet 11 may have a circular shape when viewed from above the device 10, but rise to form an approximately square apex similar to that of the flexible sheet 411 illustrated in FIG. 5A and FIG. 5B. Thus, the flexible sheet 11, when viewed from almost any perspective, may be approximately elliptical, triangular, square, rectangular, another polygonal shape, other shapes having arcuate or linear portions, or another shape or combination of such shapes. The preferred shape of the flexible sheet 11 is dependent upon a number of factors, such as the shape of the container 30, the shape of the cap 40, the connecting geometry and mechanism of the container 30 and cap 40 (if any), whether the container 30 will utilize a cap 40, and other factors. It is to be noted that the flexible nature of the flexible sheet 11 permits it to be compressed or deformed or both to assist in more compact storage of the device 10 when it is not in use. For example, the flexible sheet 11 may be compressed and deformed into the interior space of the perimeter support member 12 when it is not in use, so that the device 10 is approximately flat for storage. This also allows multiple devices 10 to be easily stacked upon one another.

A wide variety of combinations of shapes and material compositions are possible for the flexible sheet 11 of the device 10. For example, and referring to the device 310 of FIG. 4A and FIG. 4B as an example, the device 310 may be circular in shape and comprise a flexible sheet 311 constructed of more than one material. Thus, the interior portion 311*a* of the flexible sheet 311 inside boundary 311' may be constructed of one material, while the exterior portion 311*b* of the flexible sheet 311 outside boundary 311' is constructed of a different material. In this embodiment, the exterior portion 311*b* generally surrounds the interior portion 311*a* in that the exterior portion 311*b* extends around the entire perimeter of the interior portion 311*a*. In other embodiments, the exterior portion 311*b* that "surrounds" the interior portion 311*a* may not extend around the entire perimeter of the interior portion 311*a*. In the illustrated embodiment, the user of the device 310 may prefer that the interior portion 311*a* be constructed of a first material that is compatible with the contents (not illustrated) of the container 330. In such cases, however, the first material may also have a relatively small amount of clinginess, making it less suitable for adhering to itself and the sides of the container 330. In such cases, the exterior portion 311*b* may be constructed of a second material. In some instances, the second material may not be as compatible with the contents of the container 330 as the first material, but the second material may have a higher degree of clinginess than the first material. Use of two materials in this embodiment of the device 310 may therefore present less risk of contamination to the contents of the container 330, while still providing a high degree of clinginess for the exterior portion 311*b* of the flexible sheet 311 so that it better adheres to itself 311 and the sides of the container 330, thereby more firmly holding the separable portion of the flexible sheet 311 (the portion of the flexible sheet 311 inside the perforations 313, which are described in more detail below) in place relative to the container 330.

Another example of a multiple-material flexible sheet 411 may be presented in the device 410 illustrated in FIG. 5A and FIG. 5B. In this embodiment, the flexible sheet 411 may have an approximately square shape and three portions 411*a*, 411*b*, 411*c*, which may each be constructed of the same material or different materials in any combination. Thus, for example, the interior portion 411*a* may be comprised of a less clingy first material that is compatible with the contents of the container 430, the middle portion 411*b* may be comprised of a second material (or a greater thickness of the first material) that is stiffer to assist in maintaining the shape of the flexible sheet 411, and the exterior portion 411*c* may be comprised of a less content-compatible third material that has a higher degree of clinginess to assist the flexible sheet 411 in adhering to the sides of the container 430. Continuing to refer to the device 410 illustrated in FIG. 5A and FIG. 5B as an example, it is to be noted that there are many potential combinations of geometries and material compositions that may be utilized in construction of the flexible sheet 411. The preferred geometry and materials depend upon a number of factors, including the anticipated contents of the container 430, the size, shape and other characteristics of the container 430, the anticipated operating conditions of the container 430/device 410 combination, the preferences of the user of the device 410, and other factors. Thus, where the contents are food, the interior and middle portions 411*a*, 411*b* may be constructed of LDPE and the exterior portion 411*c* may be constructed of PVC. For use in the medical arts, the interior and middle portions 411*a*, 411*b* may be constructed of a material that has antimicrobial features. In other embodiments, each of the portions 411*a*, 411*b*, 411*c* may be comprised of the same or different materials, and each may have a thickness different from the other portions 411*a*, 411*b*, 411*c* in any combination. Where two or more materials are utilized in the flexible sheet 411 in this manner, the materials may be joined by any suitable means, such as an adhesive or welding or fusing, and the materials comprising the various portions 411*a*, 411*b*, 411*c* may overlap for this purpose.

Referring again to the device 310 of FIG. 4A and FIG. 4B as an example, the flexible sheet 311 may also be comprised of multiple layers of material. For example, the entire flexible sheet 311 (comprising interior portion 311*a* and exterior portion 311*b*) of the device 310 may be comprised of a first material. This first material may be a plastic film relatively incompatible with the anticipated contents of the container 330, but may have a high degree of clinginess so that it adheres well to itself 311 and the sides of the container 330. A layer of a second material (which is also depicted as interior portion 311*a* in FIG. 5A and FIG. 5B because it is semi-transparent in this embodiment, as is the remainder of the flexible sheet 311) may then be positioned over the surface of the interior portion 311*a* of the flexible sheet 311 that is intended to face the container 330. In some embodiments, the second material layer 311*a* may be utilized in this manner because it is more compatible with the contents of the container 330, but has less clinginess than the first material comprising the flexible sheet 311. In addition to increased compatibility with the container 330 contents, the double-layered interior portion 311*a* may also be stiffer due to its increased thickness (but this need not be the case in all embodiments), which may assist in holding the flexible sheet 311 away from the contents of the container 330 where this is desirable. Thus, the flexible sheet 311 of this embodiment may have an interior portion 311*a* that is compatible with the contents of the container 330 and adapted to cover the opening 331 of the container (so that it may be in contact with the contents), but also has an exterior (or peripheral) portion 311*b* that may be of a lesser thickness and more clingy nature so that it adheres well to the sides of the container 330, thereby more securely holding the device 310 operatively in place relative to the container 330. As another example, the entire flexible sheet 311 of the device 310 may be constructed of a first material that is compatible with the anticipated contents of the container 330, but which has a low degree of clinginess so that it does not adhere well to the sides of the container 330. A layer of a second material (which is also depicted as exterior portion 311*b* because it is transparent), such as an adhesive, may then be positioned on the surface of the exterior (or peripheral) portion 311*b* of the flexible sheet 311 that is intended to face the container 330. Thus, the flexible sheet 311 of this embodiment has an interior portion 311*a* that is compatible with the contents of the container 330 and adapted to cover the opening 331 of the container (so that it may be in contact with the contents), but also has an exterior (or peripheral) portion 311*b* with a layer of adhesive so that it adheres well to the sides of the container 330 and to itself 311 thereby securely holding the device 310 operatively in place relative to the container 330. In such cases, the adhesive may comprise a vegetable gum or other adhesive suitable for the operating environment of the device 310. The adhesive may also be positioned within dimples (not illustrated) in the surface of the flexible sheet 311, so that the dimples flatten as the exterior portion 311*b* is pressed against the sides of the container 330, thereby activating the adhering nature of the adhesive. Generally, in embodiments of the device 310 where multiple layers are utilized, the flexible sheet 311 on which the layers are positioned may be comprised of a single material or multiple materials, which materials may, for example, vary among the portions 311*a*, 311*b* comprising the flexible sheet 311.

It is to be noted that there are many potential combinations of geometries and material compositions that may be utilized in construction of multiple-layered flexible sheets, such as flexible sheet 311. Another example of a possible multiple-layered flexible sheet 411 is presented in the device 410 illustrated in FIG. 5A and FIG. 5B. In this embodiment, the flexible sheet 411 may have an approximately square shape and may have three portions 411*a*, 411*b*, 411*c*, which may each be constructed of one or more layers of the same material or different materials in any combination. Thus, in some embodiments, the flexible sheet 411 may first be constructed of a less content-compatible first material that has a higher degree of clinginess to assist the flexible sheet 411 in adhering to the sides of the container 430. A layer (which is also depicted as interior portion 411*a* because it is transparent in this embodiment) of a less clingy second material that is compatible with the contents of the container 430 may then be positioned on the surface of the interior portion 411*a* that faces the container 430. A layer (which is also depicted as middle portion 411*b* because it is transparent in this embodiment) of a third material (or a greater thickness of the first or second materials) that is stiffer to assist in maintaining the shape of the flexible sheet 411 may then be positioned on either surface of the middle portion 411*b*.

Figure 7:
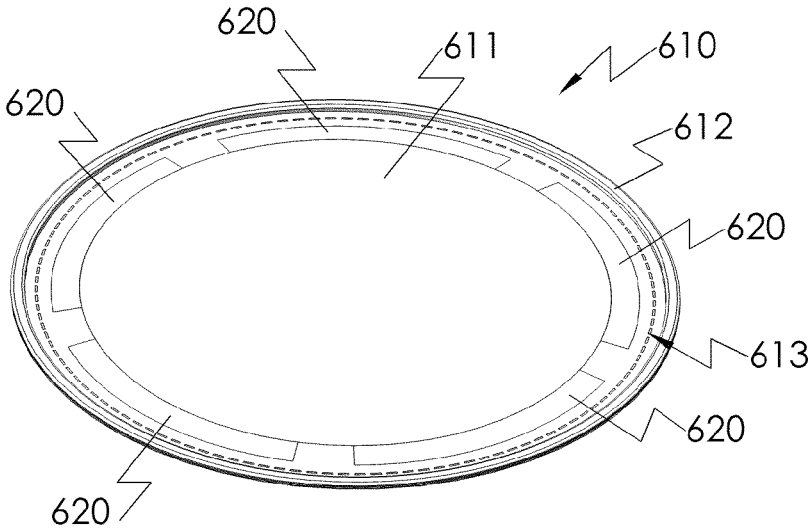
FIG. 7 is a perspective view of yet another embodiment of a device of the present invention, as viewed from the side of and above the device.

Yet another example is presented in the device 610 illustrated in FIG. 7. In this embodiment, the flexible sheet 611 may be constructed of a first material, and peripheral portions 620 around the periphery of the flexible sheet 611 may have one or more layers (which are also depicted as peripheral portions 620 because they are transparent in this embodiment) of an additional material or materials positioned on the surface of the first material comprising such portions 620. The layer or layers of each of the various peripheral portions 620 may comprise the same material or materials as the layer or layers of the other peripheral portions 620 or they may be comprised of different materials. Preferably, in the embodiment of the device 610, the flexible sheet 611 is comprised of a material that is compatible with the contents of the container (not illustrated) and a layer of adhesive or other material having a higher level of clinginess on the surface of the peripheral portions 620 of the flexible sheet 611 that face the container. In some embodiments of the device 610, the peripheral portions 620 may also be comprised of a material different than the material comprising the remainder of the flexible sheet 611.

Figure 8:
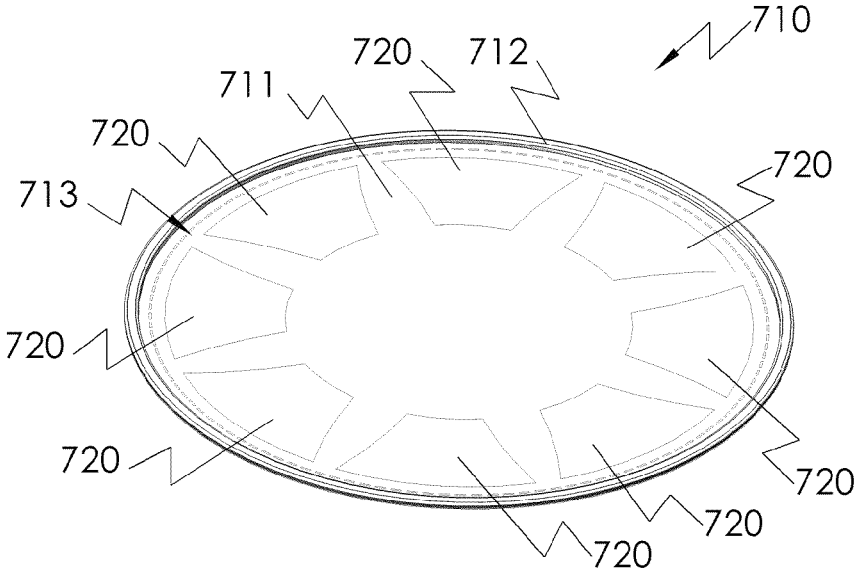
FIG. 8 is a perspective view of yet another embodiment of a device of the present invention, as viewed from the side of and above the device.

Still another example is presented in the device 710 illustrated in FIG. 8. In this embodiment, the flexible sheet 711 may be constructed of a first material, and peripheral portions 720 around the periphery of the flexible sheet 711 may have one or more layers (which are also depicted as peripheral portions 720 because they are transparent) of an additional material or materials positioned on the surface of the first material comprising such portions 720. The layer or layers of each of the various peripheral portions 720 may comprise the same material or materials as the layer or layers of the other peripheral portions 720 or they may be comprised of different materials. Preferably, in the embodiment of the device 710, the flexible sheet 711 is comprised of a material that is compatible with the contents of the container (not illustrated) and a layer of adhesive or other material having a higher level of clinginess on the surface of the peripheral portions 720 of the flexible sheet 711 that face the container. A particular advantage of this geometry is that the area of adhesive or other material having a higher level of clinginess that may come into contact with the contents of the container is minimized where the device 710 is adapted to seal the opening of containers having a variety of different sizes and shapes. The portion of the flexible sheet 711 (other than the layer) within the peripheral portions 720 may also be comprised of a material different than the material comprising the remainder of the flexible sheet 711.

Referring again to the device 310 illustrated in FIG. 4A and FIG. 4B as an example, there are many different combinations possible where multiple layers are utilized in the flexible sheet 311. For example, the flexible sheet 311 may have one or more, and possibly multiple, portions (such as portions 311*a*, 311*b*) comprising more than one layer of material. In addition, the multiple-layered portions 311*a*, 311*b* may take almost any suitable shape. The various portions 311*a*, 311*b* may also have almost any suitable thickness or combinations of thicknesses of materials. In various embodiments, some portions 311*a*, 311*b* may be comprised of one or two layers of material, while other portions 311*a*, 311*b* may be comprised of more than two layers. The materials comprising the various layers in the various portions 311*a*, 311*b* may also take many different suitable forms. Thus, the layers may take the form of sheets, films or membranes of material. In such cases, the layers may be connected together using any suitable means, such as an adhesive, welding or fusing, or inherent clinginess or tackiness. In other embodiments, the layers may take the form of a coating, which is positioned on the surface of another material using any suitable means. For example, in these embodiments, the coating may be deposited on another layer of material by spraying it in aerosol form on the other material.

As another example, the coating may be deposited by a vapor deposition process. The preferred geometry and materials comprising multiple-layer flexible sheets 311 and portions 311*a*, 311*b* thereof depend upon a number of factors, including the anticipated contents of the container 430, the size, shape and other characteristics of the device 310 and the container 330, the preferred characteristics of the materials comprising the device 310, the anticipated operating conditions of the container 330/device 310 combination, the preferences of the user of the device 310, and other factors. Thus, where the contents are food, the interior portion 311*a* may have a layer of LDPE positioned on a flexible sheet 311 constructed of PVC. Alternatively, where the contents are food, the exterior portion 311*b* may have a coating of vegetable gum adhesive or PVC positioned on a flexible sheet 311 constructed of LDPE. For use in the medical arts, the interior portion 311*a* may have a coating of an antimicrobial material deposited on a flexible sheet 311 constructed of PVC. It is to be noted, however, that use of multiple materials and multiple layers in various portions 311*a*, 311*b* of the flexible sheet 311 may or may not consider compatibility with the contents of the container 330, or may determine compatibility considering differing aspects of such compatibility, so that the composition of the various portions 311*a*, 311*b* are independent of compatibility with the contents of the container 330.

Figure 2B:
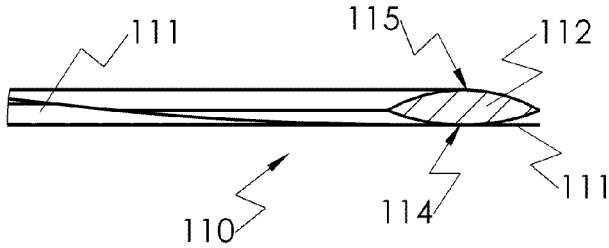
FIG. 2B is an enlarged sectional view of the embodiment of the device illustrated in FIG. 2A, as taken along the lines 2B-2B in FIG. 2A, such sectional view also illustrating the connection of the flexible sheet to the support member.
Figure 3B:
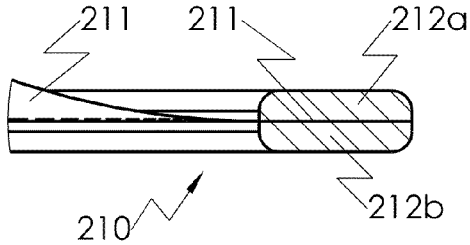
FIG. 3B is an enlarged sectional view of the embodiment of the device illustrated in FIG. 3A, as taken along the lines 3B-3B in FIG. 3A, such sectional view also illustrating the connection of the flexible sheet to the support member.

Referring again to the device 10 illustrated in FIG. 1A through FIG. 1C, the perimeter support means (perimeter support member 12 in this embodiment) of the device 10 are adapted to provide structural support for the flexible sheet 11 while the flexible sheet 11 is being positioned over the opening 31. The perimeter support member 12 also serves to hold the flexible sheet 11 in position during storage of the device 10, as well as removal of the flexible sheet 11 from its packaging or other storage container (both not illustrated), so that tangling of the flexible sheet 11 is reduced or eliminated. In the illustrated embodiment, the perimeter support means (perimeter support member 12) are also adapted to be removed from the separable portion 11' of the flexible sheet 11 after the flexible sheet 11 is positioned over the opening 31 and the cap 40 is operatively connected to the spout 32. The perimeter support member 12 may be of almost any suitable shape, but is preferably of a shape that cooperates with the flexible sheet 11 in operation of the device 10. For example, the perimeter support member 12 illustrated in FIG. 1A through FIG. 1C is approximately annular in shape to cooperate with the approximately paraboloid-shaped flexible sheet 11 having a circular base. As another example, the perimeter support member 412 (as perimeter support means) of the device 410 illustrated in FIG. 5A and FIG. 5B is approximately square to cooperate with the square flexible sheet 411 of the device 410. As yet another example, the perimeter support member 412 may also comprise handles 412*a*, which may take the form of tabs, grips, knobs or other protrusions extending from the perimeter support member 412, as illustrated, to assist in handling of the device 410. Thus, and referring again to the device 10 illustrated in FIG. 1A through FIG. 1C as an example, the perimeter support member 12, when viewed from various perspectives, may be approximately elliptical, triangular, square, rectangular, another polygonal shape, other shapes having arcuate or linear portions, or another shape or combination of such shapes. Similarly, the cross-sectional shape of the perimeter support member 12 may be of almost any suitable shape, but is typically of a shape that cooperates with the flexible sheet 11 in operation of the device 10. For example, in the device 110 illustrated in FIG. 2B, the perimeter support member 112 cross-section may have a lens shape. As another example, in the device 210 illustrated in FIG. 3B, the perimeter support member 212*a*, 212*b* may have an approximately rectangular shape. As is also illustrated in FIG. 3B, the perimeter support member 212*a*, 212*b* may also be comprised of more than one component, as described in more detail below. Thus, and referring again to the device 10 illustrated in FIG. 1A through FIG. 1C as an example, the cross-sectional shape of the perimeter support member 12, when viewed from various perspectives, may be approximately elliptical, triangular, square, rectangular, another polygonal shape, other shapes having arcuate or linear portions, or another shape or combination of such shapes. The perimeter support member 12 may not have a constant thickness or other cross-sectional dimension or shape along its length, as illustrated and described in more detail below in connection with the device 510 illustrated in FIG. 6.

It is to be noted that the perimeter support member 12 may extend around the entire perimeter of the flexible sheet 11, as is the case with the device 10 illustrated in FIG. 1A through FIG. 1C. In other embodiments, the perimeter support member 12 may only extend around a portion of the perimeter of the flexible sheet 11. For example, there may be one or more gaps in the perimeter support member 12 that allow the perimeter support member 12 to be folded, as illustrated and described in more detail below in connection with the device 510 illustrated in FIG. 6. Considering the device 10 of FIG. 1A through FIG. 1C as a reference, there may also be multiple gaps, and gaps of varying sizes and shapes (not illustrated), along the perimeter support member 12 in order to accommodate particular uses of the device 10. The preferred shape and geometry of the perimeter support member 12 is dependent upon a number of factors, such as the shape and thickness of the flexible sheet 11, the shape of the container 30, the shape of the cap 40, if any, the connecting geometry and mechanism of the container 30 and cap 40, whether the container will utilize a cap 40, and other factors. Preferably, the flexible sheet 11 does not extend beyond the outside perimeter of the perimeter support member 12, as illustrated in FIG. 1A through FIG. 1B, but this need not be the case in all embodiments. The perimeter support member 12 may also be positioned within the perimeter boundary of the flexible sheet 11 in a manner that does not interfere with the sealing operation of the flexible sheet 11, as opposed to exactly along the perimeter boundary of the flexible sheet 11. These variations in the possible positioning of the perimeter support member 12 relative to the flexible sheet 11 give rise to the perimeter support member 12 being positioned at "approximately" the perimeter of the flexible sheet 11.

The perimeter support member 12 may be comprised of any material suitable for constructing support members functioning in the manner as the perimeter support member 12. Preferably, the perimeter support member 12 is comprised of a semi-rigid or rigid material.

Examples include metals (such as steel, steel alloys, aluminum, copper, brass, or other metals or metal alloys), polymers (such as polyvinyl chloride (PVC), polyethylene, acrylonitrile butadiene styrene (ABS), rubber, synthetic rubber (including NEOPRENE), silicon, and other polymers), wood, paper, glass, fiberglass, carbon-based and other composites, or other materials or a combination of such materials. The perimeter support member 12 may also be constructed of the same materials that are used to construct the flexible sheet 11, but this need not be the case in all embodiments. The preferred material is dependent upon a number of factors, such as the degree of support desired for the flexible sheet 12, the material composition of the flexible sheet 11, the type of sheet connecting means (described in more detail below) utilized in the device 10, and other factors. More preferably, the shape and material composition of the perimeter support member 12 are such that the perimeter support member 12 is adequate to perform its anticipated functions, as described in more detail above. The perimeter support member 12 may be fabricated using any suitable means, which are well known in the relevant art. For example, a perimeter support member 12 comprised of PVC may be fabricated by injection molding. As another example, where the perimeter support member 12 and the flexible sheet 11 are constructed of the same material, they may be fabricated together as a single integrated unit, also using techniques that are well known in the relevant art, such as injection molding.

The sheet connecting means of the device 10 illustrated in FIG. 1A through FIG. 1C are adapted to operatively connect the flexible sheet 11 to the support member 12. Generally, the sheet connecting means of the device 10 may comprise any suitable connecting means currently known in the relevant art or that may be developed in the art in the future. Examples include clasps, clamps, clips, pins, hinges, adhesives, epoxies, welding, fusing, nails, screws, nuts, bolts, or other types of fasteners or connectors, either alone or in conjunction with one another in different combinations. Preferably, the sheet connecting means are comprised of an adhesive that is compatible with the materials comprising the flexible sheet 11 and the perimeter support means (perimeter support member 12), as well as the anticipated use of the device 10 (such as where toxicity may be a concern). Where the perimeter support member 12 and the flexible sheet 11 are constructed of the same material, which is more preferred, the sheet connecting means preferably comprise fabricating them together as a single integrated unit using techniques that are well known in the relevant art, such as injection molding. As illustrated in the device 110 of FIG. 2A and FIG. 2B, the sheet connecting means may connect the flexible sheet 111 to the perimeter support member 112 along only one surface 114, such as the surface 114 opposite the side of the device 110 out of which the flexible sheet 111 operatively extends. In other embodiments, the sheet connecting means may connect the flexible sheet 111 to the surface 115 of the perimeter support member 112 on the side of the device 110 out of which the flexible sheet 111 extends. In still other embodiments, the sheet connecting means may involve more than one surface 114, 115 of the device 110, such as where the flexible sheet 111 is wrapped around the all or a portion of both surfaces 114, 115. As illustrated in the device 210 of FIG. 3A and FIG. 3B, where the perimeter support means (support members 212*a*, 212*b* in this embodiment) are comprised of more than one member, the sheet connecting means may connect the surfaces of the support members 212*a*, 212*b* facing each other to the flexible sheet 211. In other embodiments, the sheet connecting means may be used to connect all or a portion of any of the surfaces of the support members 212*a*, 212*b*, such as where the flexible sheet 211 passes between the support members 212*a*, 212*b* and is then wrapped around one or more of the outside surfaces of one or more of the support members 212*a*, 212*b*.

Referring again to the device 10 illustrated in FIG. 1A through FIG. 1C, and as best illustrated in FIG. 1C, the separation means (perforations 13 in this embodiment) are adapted to operatively separate a separable portion 11' of the flexible sheet 11 from the remainder of the device 10 so that the separated portion 11' of the flexible sheet 11 is adapted to seal the container opening 31. It is to be noted that the separable portion 11' of the flexible sheet 11 "adapted to seal the container opening 31" includes the portion of the flexible sheet 11 that is positioned over the opening 31, as well as portions of the flexible sheet 11 that are positioned against the portions (sides of the spout 32) of the container 30 adjacent to the opening 31. The separable portion 11' of the flexible sheet 11 that is separated from the remainder of the device 10 is generally the portion 11' of the flexible sheet 11 that is bounded by the perimeter formed by the separation means (perforations 13). In this context, the remainder of the device 10 is all portions of the device 10 other than the separable (or separated) portion 11' of the flexible sheet that is bounded by the perimeter formed by the separation means (perforations 13). Thus, after the device 10 has been positioned over the opening 31 of the container 30 so that the flexible sheet 11 is adapted to seal the opening 31, the perimeter support member 12 may be pulled away from the opening 31 (preferably longitudinally along the container 30 in a direction away from the opening 31 so that the flexible sheet 11 is pressed down onto the portion of the container 30 (the spout 32) adjacent to the opening 31). As the flexible sheet 11 is pulled taut between the container spout 32 and the perimeter support member 12, the small portions of the flexible sheet 11 between the perforations 13 are torn, so that the separable (or separated) portion 11' of the flexible sheet 11 is separated from the remainder of the device 10. The parts of the separated portion 11' of the flexible sheet 11 that do not cover the opening 31 may then be pressed against the sides of the spout 32 to enhance the seal of the opening 31 by the separated portion 11' of the flexible sheet 11. Being removed from the separated portion 11' of the flexible sheet 11, which is the portion 11' of the device 10 actually used to seal the opening 31, the remainder of the device 10 does not interfere with use and operation of the container 30 and may be discarded by the user of the device 10. In embodiments where a cap 40 is present and utilized, the flexible sheet 11 may be positioned over the opening 31 of the container 30, and the cap 40 may then be operatively connected to the container 30 (by means of rotating the cap 40 down onto the spout 32 in this embodiment). The perimeter support member 12 may then be pulled away from the opening 31 (preferably longitudinally along the container 30 in either direction away from the opening 31 and cap 40 so that the separable (or separated) portion 11' of the flexible sheet 11 is pulled taut between the container spout 32 and cap 40, on the one hand, and the perimeter support member 12 on the other), so that the separable portion 11' of the flexible sheet 11 is separated from the remainder of the device 10.

The preferred separation means for the device 10 are comprised of a series of perforations 13 forming a perimeter for the separable portion 11' of the flexible sheet 11. The perforations 13 may have almost any suitable shape or form, as may the portions of the flexible sheet 11 between the perforations 13. The preferred shape of the perforations 13 is as illustrated in the device 10 of FIG. 1A through FIG. 1C. In other embodiments, the separation means of the device 10 may comprise any suitable separating means currently known in the relevant art or that may be developed in the art in the future. For example, the separation means may be comprised of slits (not illustrated) that form a perimeter around the separable portion 11' of the flexible sheet 11. As another example, the flexible sheet 11 may comprise a segment (not illustrated) that has a reduced thickness, as compared to the remainder of the flexible sheet 11, so that the segment of reduced thickness serves to form the perimeter of the separable portion 11' of the flexible sheet 11. Still another example is a form of sheet connecting means (such as an adhesive) that is adapted to release upon the application of a designated force great enough to pull the flexible sheet 11 from the perimeter support member 12. In this example, when a designated level of tautness is reached in the flexible sheet 11 as the perimeter support member 12 is pulled away from the opening 31, the sheet connecting means release so that the flexible sheet 11 pulls away from the perimeter support member 12. Thus, the separable portion 11' of the flexible sheet 11 becomes the entire flexible sheet 11 in this example. In yet another example, particularly where a cap 40 is operatively connected to the container 30, the separation means may be comprised of merely pulling the perimeter support member 12 away from the container 30 so that a portion 11' of the flexible sheet 11 is torn away, the flexible sheet 11 having a thickness and material features adapted for tearing away upon an appropriate level of force being exerted during operation of the device 10, as described in more detail below. It is to be noted that not all embodiments of the present invention may include separation means.

The device 10 illustrated in FIG. 1A through FIG. 1C may be constructed using any suitable means currently known in the art or that may be developed in the relevant art in the future. Preferably, and in any order, the flexible sheet 11 and the perimeter support means (perimeter support member 12) are formed, as illustrated in FIG. 1A through FIG. 1C and described in more detail above in connection with the device 10. The perimeter support member 12 is then operatively attached to the flexible sheet 11 using any appropriate means, such as an adhesive. Separation means (perforations 13) may be applied to the flexible sheet 11 as a part of the fabrication of the flexible sheet 11, or may be added as a part of operatively attaching the perimeter support member 12 to the flexible sheet 11, or may be added after such attachment. Separation means comprised of perforations 13 may be manufactured using any appropriate means, such an appropriate die to cut them. Where the device 10 comprises a unitary flexible sheet 11 and perimeter support member 12, which is preferred, they may be formed together in a single step by any appropriate means, such as injection molding. In this case, separation means (perforations 13) may be applied to the device 10 as a part of the fabrication of the flexible sheet 11 and perimeter support member 12 or may be added after such fabrication. Separation means comprised of perforations 13 may be manufactured using any appropriate means, such as inclusion in an injection mold or an appropriate die to cut them.

In operating the device 10, the flexible sheet 11 of the device 10 may be positioned over the opening 31 of the container 30, and the cap 40 may then be placed over the spout 32 and the flexible sheet 11. As the cap 40 is rotated down onto the spout 32, the flexible sheet 11 is deformed to conform to the exterior surface of the spout 32 and the interior surface of the cap 40, thereby tending to fill the space between the cap 40 and spout 32 within the overlapping threads 33 of the spout 32 and the cap 40. As a result, the opening 31 of the container 30 is adapted to be operatively sealed, and a seal is adapted to be formed between the container opening 31 and the cap 40, so that the contents of the container 30 preferably do not spill out through the opening 31 of the container 30 when the container 30 is oriented in various positions (such as upside down) in which the contents might ordinarily leak through the space between the spout 32 and cap 40. It is to be noted, however, that although the device 10 is adapted to seal the opening 31 of the container 30, the resulting seal may not be adequate in all instances to prevent the spillage of the contents of the container 30 through the opening 31. The perimeter support member 12 may then be pulled away from the opening 31 (preferably longitudinally along the container 30 in a direction away from the opening 31 so that the flexible sheet 11 is pressed down onto the portion of the container 30 (the spout 32) adjacent to the opening 31). The perimeter support member 12 may then be preferably pulled longitudinally along the container 30 in either direction away from the opening 31 and cap 40 so that the separable portion 11' of the flexible sheet 11 is pulled taut between the container spout 32 and cap 40, on the one hand, and the perimeter support member 12 on the other, so that the separable portion 11' of the flexible sheet 11 is separated from the remainder of the device 10 along the perimeter formed by the perforations 13.

The devices 110 and 210 illustrated in FIG. 2A and FIG. 2B, and FIG. 3A and FIG. 3B, respectively, represent different embodiments of the flexible sheet 111, 211, perimeter support means (perimeter support members 112, 212*a*, 212*b*), and sheet connecting means, respectively, all as described in more detail above in connection with the device 10 illustrated in FIG. 1A through FIG. 1C. The device 310 illustrated in FIG. 4A and FIG. 4B also represents another embodiment of the present invention. In this embodiment, the container 330 generally tends to have a relatively larger opening 331, which may also generally be of a size similar to the remaining portion 334 of the container 330. The portion 332 of the container 330 adjacent to the opening 331 has a geometry that cooperates with the geometry of the cap 340 to permit the cap 340 to be operatively connected to the container 330. The device 310 is comprised of perimeter support means (described in more detail below) and a flexible sheet 311 having an approximately convex or concave shape. In other embodiments, the flexible sheet 311 may have any of the same structure, features, characteristics, functions and operation as any of the flexible sheets 11, 111, 211, 311, 411, 611, 711, 811, 911, 1011, 1111, 1211 illustrated and described herein in more detail in connection with FIG. 1A through FIG. 13B. Although the illustrated perimeter support means of the device 310 are comprised of an annularly-shaped perimeter support member 312, in other embodiments of the device 310 the perimeter support means may have any of the same structure, features, characteristics, functions and operation as the perimeter support means (perimeter support member 12) illustrated and described above in more detail in connection with FIG. 1A through FIG. 1C. The device 310 may be operated in a manner substantially the same as the device 10 illustrated in FIG. 1A through FIG. 1C. In this embodiment, however, the cap is a lid 340 that is operatively connected to the container 330 by cooperating geometry (other than threads), so that the flexible sheet 311 forms a seal by filling the space between the portion 332 of the container 330 adjacent to the opening 331 of the container 330 and the cap (lid 340). It is to be noted that the device 310 may also seal the opening 331 of the container 330 without the cap (lid 340) being operatively connected to the container 330. In this case, the flexible sheet 311 of the device 310 is positioned over the opening 331 of the container 330. The perimeter support member 312 may then be pulled longitudinally along the container 330 in a direction away from the opening 331 so that the flexible sheet 311 is pressed down onto the portion 332 of the container 330 adjacent to the opening 331. As the flexible sheet 311 is pulled taut between the container portion 332 and the perimeter support member 312, the small portions of the flexible sheet 311 between the perforations 313 are torn, so that the separable portion of the flexible sheet 311 (the portion bounded by the perforations 313) is separated from the remainder of the device 310. The portions of the separated portion of the flexible sheet 311 that do not cover the opening 331 may then be pressed against the sides of the container portion 332 to enhance the seal of the opening 331 by the separated portion of the flexible sheet 311. Being removed from the separated portion of the flexible sheet 311, which is the portion of the device 310 actually used to seal the opening 331, the remainder of the device 310 does not interfere with use and operation of the container 330 and may be discarded by the user of the device 310.

The device 410 illustrated in FIG. 5A and FIG. 5B represents yet another embodiment of the present invention. In this embodiment, the container 430 is generally of the same type as the container 330 illustrated in FIG. 4A and FIG. 4B, but is approximately square or rectangular in shape. The portion 432 of the container 430 adjacent to the opening 431 has a geometry that cooperates with the geometry of a cap (not illustrated) to permit the cap to be operatively connected to the container 430. The device 410 is comprised of perimeter support means (described in more detail below) and a flexible sheet 411 having an approximately square or rectangular shape. In other embodiments, the flexible sheet 411 may have any of the same structure, features, characteristics, functions and operation as the flexible sheets 11, 111, 211, 311, 411, 611, 711, 811, 911, 1011, 1111, 1211 illustrated and described above in more detail in connection with FIG. 1A through FIG. 13B. Although the illustrated perimeter support means of the device 410 are comprised of a square perimeter support member 412, in other embodiments of the device 410 the perimeter support means may have any of the same structure, features, characteristics, functions and operation as the perimeter support means (perimeter support member 12) illustrated and described above in more detail in connection with FIG. 1A through FIG. 1C. The device 410 may be operated in a manner substantially the same as the device 310 illustrated in FIG. 4A and FIG. 4B. Referring to the device 410 illustrated in FIG. 5A and FIG. 5B as an example, it is to be noted that in the various embodiments of the device 410, the device 410 need not be used with a similarly shaped container 430. For example, it is possible to use a square device 410 with a container 430 that has an opening 431 that is of a shape other than square, such as circular, elliptical or hexagonal. It is also not necessary that the flexible sheet 411 of the device 410 cover the entire area of the opening 431 in all embodiments.

The device 510 illustrated in FIG. 6 represents yet another embodiment of the present invention. In this embodiment, the device 510 may have any of the same structure, features, characteristics, functions and operation as any embodiments of the devices 10, 110, 210, 310, 410 illustrated and described above in more detail in connection with FIG. 1A through FIG. 5B. Thus, the flexible sheet 511 may have any of the same structure, features, characteristics, functions and operation as the flexible sheets 11, 111, 211, 311, 411, 611, 711, 811, 91, 1011, 1111, 1211 illustrated and described above in more detail in connection with FIG. 1A through FIG. 13B. In this embodiment, however, the device 510 is further comprised of folding means for adapting the device 510 to be folded or compacted. This capability may assist in storage of the device 510 while it is not in use, as well as in operation of the device 510. In the illustrated embodiment, the perimeter support means are comprised of an annular-shaped perimeter support member 512 that has two portions 512' of reduced thickness. These two portions 512' comprise the folding means and are positioned on approximately opposite sides of the perimeter support member 512, so that the perimeter support member 512 may be folded along an axis formed by a line between the two portions 512'. The flexible sheet 511 is also preferably folded along the same axis, as illustrated in FIG. 6, but the flexible sheet 511 need not be folded along this axis in all embodiments. By folding the device 510, it takes up less space for more convenient storage. It is to be noted that multiple devices 510 may be folded and stacked together. Any suitable means or mechanisms may be provided for folding the device 510. For example, rather than having one or more sections of reduced thickness, the perimeter support member 512 may have one or more gaps therein (not illustrated), and the fold may be made along the gaps. As another example, the perimeter support member 512 may comprise one or more hinges, pins, pivots, or other devices or mechanisms, or a combination thereof, that permit the perimeter support member 512 to be folded or compacted. As yet another example, the perimeter support member 512 may be comprised of a resilient material that allows it to be bent or twisted (considered to be within the definition of "folded" or "compacted" herein) and then returned to its original shape. Thus, a device 510 with a resilient perimeter support member 512 may be bent or twisted (or both) into the desired shape for storage, may have the position of the device 10 constrained by its packaging (not illustrated), and may then spring back to the original non-folded shape when the device 10 is removed from its packaging for use. It is to be noted that the perimeter support member 512 may also provide for multiple folds and for overlapping and non-overlapping folds, so that the perimeter support member 512 may be folded in any suitable manner.

The devices 610 and 710 illustrated in FIG. 7 and FIG. 8, respectively, represent yet other embodiments of the present invention. These devices 610, 710 generally illustrate different embodiments of exterior or peripheral portions 620, 720, respectively, (and also supplemental sealing means, as described in more detail below) of the flexible sheets 611, 711, respectively, as described in more detail above. In these embodiments, the devices 610, 710 may have any of the same structure, features, characteristics, functions and operation as any embodiments of the devices 10, 110, 210, 310, 410, 510 illustrated and described above in more detail in connection with FIG. 1A through FIG. 6. Thus, the flexible sheets 611, 711 may have any of the same structure, features, characteristics, functions and operation as the flexible sheets 11, 111, 211, 311, 411, 611, 711, 811, 911, 1011, 1111, 1211 illustrated and described in more detail herein in connection with FIG. 1A through FIG. 13B. Similarly, the perimeter support means (perimeter support members 620, 720, respectively, in these embodiments), and the separation means (perforations 613, 713, respectively, in these embodiments) may have any of the same structure, features, characteristics, functions and operation as any embodiments of the perimeter support means (perimeter support members 12, 112, 212, 312, 412, 512) and the sheet separation means (perforations 13, 113, 213, 313, 413, 513) illustrated and described above in more detail in connection with FIG. 1A through FIG. 6.

Figure 9:
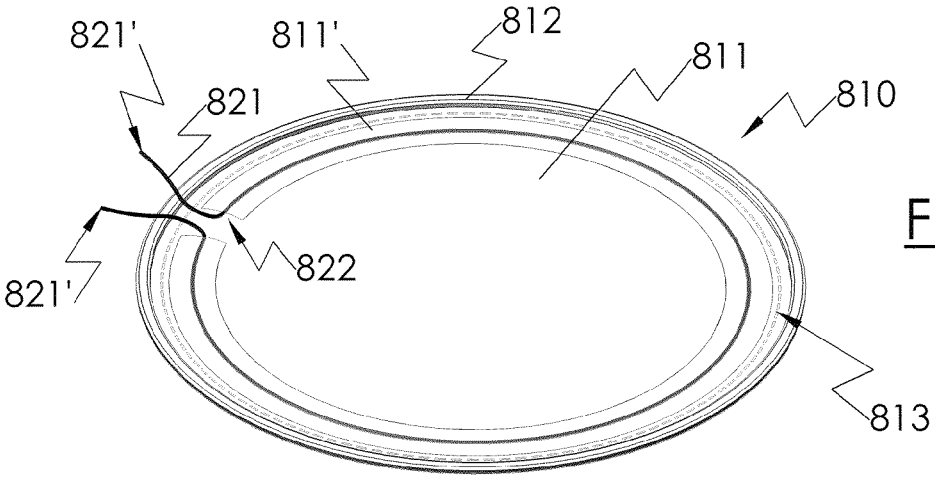
FIG. 9 is a perspective view of yet another embodiment of a device of the present invention, as viewed from the side of and above the device.

The device 810 illustrated in FIG. 9 represents yet another embodiment of the present invention. In this embodiment, the device 810 may generally have any of the same structure, features, characteristics, functions and operation as any embodiments of the devices 10, 110, 210, 310, 410, 510, 610, 710, 910 illustrated and described above in more detail in connection with FIG. 1A through FIG. 10 (excluding FIG. 9). This device 810, however, represents an embodiment comprising mechanical sealing means (and also supplemental sealing means, as described in more detail below) adapted for assisting the flexible sheet 811 in sealing the container opening (not illustrated). In this embodiment, the device 810 further comprises a drawstring sealing mechanism, which is further comprised of a drawstring 821 generally positioned within an interior space 822 created by sealing the longitudinal edge portions of a second layer 811' of material (which is transparent in the illustrated embodiment) to the material comprising the flexible sheet 811. The drawstring 821 is generally free to move relative to the flexible sheet 811. The drawstring 821 is preferably positioned approximately around the perimeter of the separable portion of the flexible sheet 811 (the portion of the flexible sheet 811 inside the perforations 813), with distal ends 821' that extend from the interior space 822. By "approximately around the perimeter," it is meant that the drawstring 821 and the interior space 822 in which it is positioned may be adjacent to the sheet separation means (perforations 813 in this embodiment) or there may be a space (which may vary from location to location along the drawstring 821) between the drawstring 821 and the perforations 813. Thus, after the perimeter support member 812 (as perimeter support means) has been removed from the separable portion of the flexible sheet 811, the perimeter edges of the separated portion of the flexible sheet 811 may be pulled down over the sides of the container, and the ends 821' of the drawstring 821 may then be pulled in generally opposing directions. This action generally causes the perimeter edges of the separated portion of the flexible sheet 811 to be drawn against the sides of the container or toward one another under the bottom of the container (where the container may be relatively shallow), and thereby assist in holding the device 810 operatively in place relative to the container. It is to be noted that multiple variations are possible with respect to the mechanical sealing means of the present invention. For example, there may be more than one drawstring 821 or more than one interior space 822 or both in any suitable combinations. Each drawstring 821 and interior space 822 may also have almost any shape or geometry. The drawstring 821 may also take any suitable form, such as a string, rope, cable or chain or any combination thereof, and may be comprised of almost any suitable material, such as those used to construct string, rope, cable or chains, which may include metal (such as steel, steel alloys, aluminum, copper, brass, or other metals or metal alloys), polymers (such as PVC, polyethylene, polypropylene, ABS, and other polymers), wood, fiberglass, carbon-based or other composites, paper, or other materials or a combination of any such materials. The preferred geometry and materials comprising the mechanical sealing means (drawstring 821 and interior space 822 in this embodiment) depend upon a number of factors, including the anticipated contents of the container, the size, shape and other characteristics of the device 810 and the container, the preferred characteristics of the materials comprising the device 810, the anticipated operating conditions of the container/device 810 combination, the preferences of the user of the device 810, and other factors.

Figure 10:
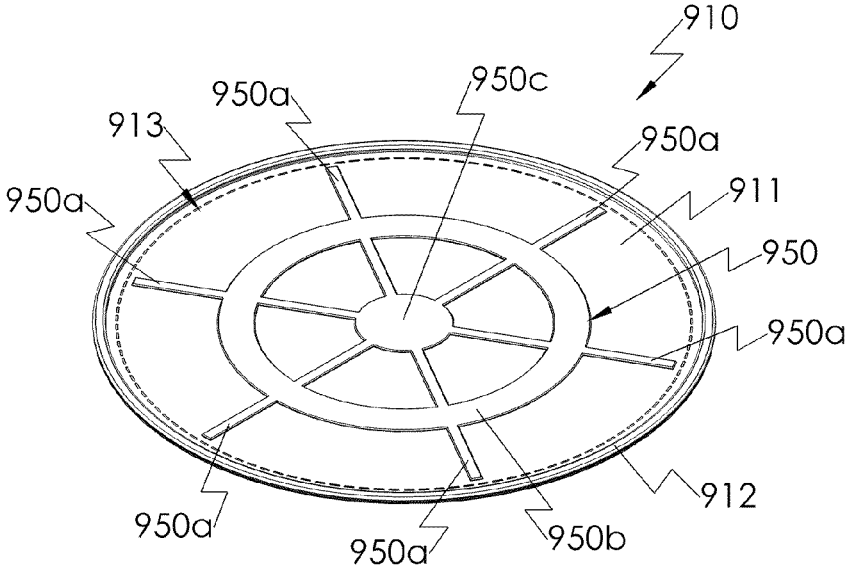
FIG. 10 is a perspective view of yet another embodiment of a device of the present invention, as viewed from the side of and above the device.

The device 910 illustrated in FIG. 10 represents yet other embodiment of the present invention. In this embodiment, the device 910 may generally have any of the same structure, features, characteristics, functions and operation as any embodiments of the devices 10, 110, 210, 310, 410, 510, 610, 710, 810 illustrated and described above in more detail in connection with FIG. 1A through FIG. 9. This device 910, however, represents an embodiment comprising internal support means for assisting in operatively holding the separable portion (the portion of the flexible sheet 911 bounded by the perforations 913) of the flexible sheet 911 operatively in place. In this embodiment, the internal support means of the device 910 are comprised of an internal support structure 950, which is further comprised of one or more (and a plurality in this embodiment) of radial support members 950*a*, an intermediary (annular-shaped in this embodiment) support member 950*b*, and a central support member 950*c*. Although the geometry of the illustrated internal support structure 950 is preferred for devices 910 having a generally round shape, the internal support structure 950 may have other geometries and shapes in other embodiments. For example, the internal support structure 950 may have linear internal support members positioned in a grid pattern where the device 910 is generally square or rectangular in shape. Thus, the internal support structure 950, when viewed from various perspectives, may be generally and approximately elliptical, triangular, square, rectangular, another polygonal shape, other shapes having arcuate or linear portions, or another shape or combination of such shapes. The internal support structure 950 may also lie in more than one plane. The internal support means (internal support structure 950 in this embodiment) may also be comprised of any suitable number of internal support members 950*a*, 950*b*, 950*c*.

Further, the various internal support members 950*a*, 950*b*, 950*c* comprising the internal support structure 950 may be of almost any suitable size and shape, but are typically of a size and shape that cooperate with the flexible sheet 911 in operation of the device 910. The cross-sectional shapes of the internal support members 950*a*, 950*b*, 950*c* comprising the internal support structure 950 may also be of almost any suitable size and shape, but are typically each of a size and shape that cooperate with the flexible sheet 911 in operation of the device 910. For example, in the device 910 illustrated in FIG. 10, the internal support members 950*a*, 950*b*, 950*c* have a generally rectangular cross-sectional shape. In other embodiments, the internal support members 950*a*, 950*b*, 950*c*, when viewed from various perspectives, may also be approximately elliptical, triangular, square, another polygonal shape, other shapes having arcuate or linear portions, or another shape or combination of such shapes. One or more of the internal support members 950*a*, 950*b*, 950*c* may also not have a constant thickness or other cross-sectional dimension or shape along its length. There may also be one or more gaps of varying sizes and shapes (not illustrated) in the internal support structure 950. These gaps may allow the internal support structure 950 to be bent, flexed or folded, as may be the case with the device 510 illustrated and described in more detail above in connection with FIG. 6. The preferred shape and geometry of the internal support structure 950 is dependent upon a number of factors, such as the size, shape and thickness of the flexible sheet 911, the size and shape of the container (not illustrated), the connecting geometry and mechanism of the container and cap (not illustrated), whether the container will utilize a cap, and other factors.

The internal support structure 950 may be comprised of any material suitable for constructing the perimeter support member 12, as described in more detail above and illustrated in conjunction with FIG. 1A through FIG. 1C. The preferred material is dependent upon a number of factors, such as the degree of support desired for the flexible sheet 911, the material composition of the flexible sheet 911, the size, shape and thickness of the flexible sheet 911, and other factors. More preferably, the internal support structure 950 is constructed of the same materials that are used to construct the flexible sheet 911, but this need not be the case in all embodiments. The internal support structure 950 may be fabricated using any suitable means, which are well known in the relevant art. For example, an internal support structure 950 comprised of PVC may be fabricated by injection molding. The internal support structure 950 may be attached to the flexible sheet 911 along all or a portion of its various lengths by any suitable means, such as an adhesive or welding or fusing. As another example, where the internal support structure 950 and the flexible sheet 911 are constructed of the same material, they may be fabricated together as a single integrated unit, also using techniques that are well known in the relevant art, such as injection molding.

In operation, the device 910 may be positioned over the opening of the container. The device 910 may then be pulled down over the container opening. Assuming the container has a generally circular opening of approximately the same size as the exterior diameter of the intermediary support member 950*b*, this downward action may cause the portion of the radial support members 950*a* external to the intermediary support member 950*b* to bend downward toward the outside surfaces of the container. At some point, the material comprising the flexible sheet 911 between the perforations 913 will give way, so that the perimeter support member 912 is separated from the separable portion of the flexible sheet 911. The radial support members 950*a* and the portions of the flexible sheet 911 external to the intermediary support member 950*b* may then be bent down and pressed against the sides of the container. Thus, a portion of the internal support structure 950 (the external portions of the radial support members 950*a* in this case) may assist in sealing the separated portion of the flexible sheet 911 to the sides of the container. Other portions of the internal support structure 950 (the internal portions of the radial support members 950*a*, the intermediary support member 950*b*, and the central support member 950*c* in this case) may assist in holding the flexible sheet 911 in a desired shape while the flexible sheet 911 is positioned over the opening of the container.

Figure 11:
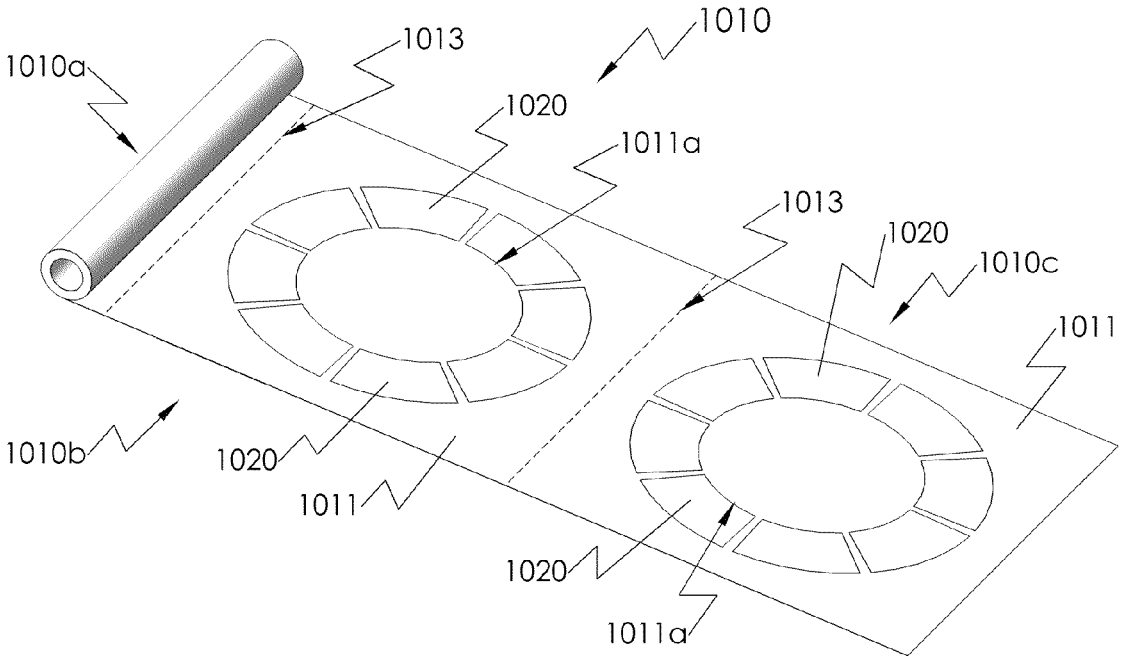
FIG. 11 is a perspective view of yet another embodiment of a device of the present invention, as viewed from the side of and above the device.

Referring to the device 1010 illustrated in FIG. 11 as an example, it is to be noted that in certain embodiments where the flexible sheet 1011 is comprised of multiple materials or multiple layers or both, the device 1010 may not utilize a perimeter support member. For example, the device 1010 may be in the form of a roll 1010*a* of material comprising the flexible sheet 1011, as is the case with plastic wrap well known in the relevant art. In this embodiment, the flexible sheet 1011 may be comprised of separable portions (such as segments 1010*b*, 1010*c* in this embodiment), which are segregated by, and may be separated by, separation means (perforations 1013 in this embodiment), which may have substantially any of the same structures, features, characteristics, functions and operation as the separation means (perforations 13) described in more detail above and illustrated in conjunction with FIG. 1A through FIG. 1C. Referring again to the device 1010 illustrated in FIG. 11, the flexible sheet 1011 may also be comprised of an interior portion 1011*a*, at least a portion of which is adapted to be positioned over the opening of a container (not illustrated), and one or more peripheral portions 1020 (also as supplemental sheet sealing means), wherein at least a portion of the peripheral portions 1020 is adapted to be positioned adjacent to the container. In the illustrated embodiment, the interior portion 1011*a* is generally the portion of the flexible sheet 1011 encompassed by the boundary formed by the interior edges of the peripheral portions 1020. The peripheral portions 1020 may be comprised of a different material than the material comprising the remainder of the flexible sheet 1011, or the peripheral portions 1020 may have a layer of a material positioned on a surface thereof, or both. In addition, the interior portion 1011*a* may be comprised of a material different from the remainder of the flexible sheet 1011 or may have a layer of material positioned on a surface thereof, or both. Thus, where the container contents include food, the flexible sheet 1011 may be constructed of LDPE and the peripheral portions 1020 may have a coating of PVC positioned on the flexible sheet 1011 within the boundaries of the peripheral portions 1020. The peripheral portions 1020 may have almost any suitable shape or combination of shapes. Thus, when viewed from various perspectives, the peripheral portions 1020 may be generally and approximately elliptical, triangular, square, rectangular, another polygonal shape, other shapes having arcuate or linear portions, or another shape or combination of such shapes. The device 1010 may be constructed using substantially any of the methods used to construct the any of the devices 310, 410, 610, 710 described in more detail above and illustrated in conjunction with FIG. 4A through FIG. 5B and FIG. 7 through FIG. 8. In particular, and referring again to the device 1010 of FIG. 11, the device 1010 may be manufactured by positioning a layer of material, such as an adhesive or a material having greater clinginess than the material comprising the remainder of the flexible sheet 1011, on the flexible sheet 1011. The positioning of material is preferably accomplished by spraying a coating in aerosol form or by a vapor deposition process. In operation, a separable portion (such as segment 1010*c*) may be removed from the roll 1010*a* by tearing along the separation means (perforations 1013) separating segment 1010*b* from segment 1010*c*. The separated portion (segment 1010*c*) may then be positioned over, and be used to operatively seal, the opening of the container.

Figure 12:
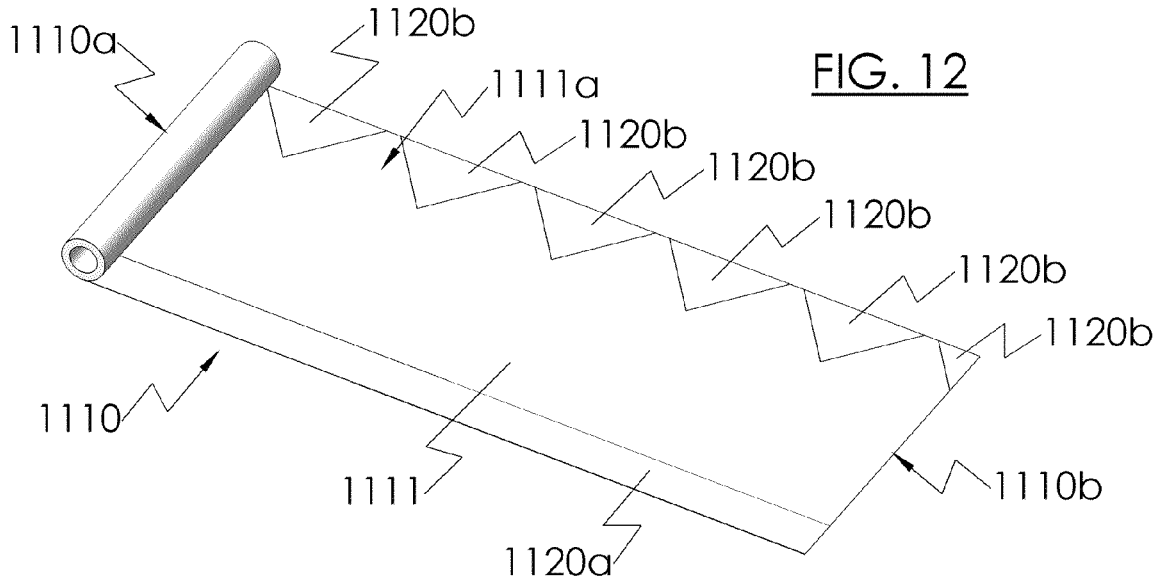
FIG. 12 is a perspective view of yet another embodiment of a device of the present invention, as viewed from the side of and above the device.

Many different combinations of features are possible for the embodiment of the present invention represented by the device 1010. For example, the device 1110 illustrated in FIG. 12 is also comprised of a flexible sheet 1111 that may be in the form of a roll 1110*a* of material, which flexible sheet 1111 may have substantially any of the structures, features, characteristics, functions and operation as the flexible sheet 1011 illustrated and described in more detail above in conjunction with FIG. 11. In the embodiment illustrated in FIG. 12, however, the device 1110 does not include separation means to segregate the flexible sheet 1111 into segments. Instead, portions of the flexible sheet 1111 (such as portion 1110*b*) may be removed from the roll 1110*a* by pulling them outward from the roll 1110*a* and cutting them away from the roll 1110*a*, as is the case with conventional plastic wrap well known in the relevant art. The flexible sheet 1111 may also be comprised of an interior portion 1111*a*, at least a portion of which is adapted to be positioned over the opening of a container (not illustrated), and one or more peripheral portions 1120*a*, 1120*b* (also as supplemental sheet sealing means), wherein at least a portion of the peripheral portions 1120*a*, 1120*b* is adapted to be positioned adjacent to the container. In the illustrated embodiment, the interior portion 1111*a* is generally the portion of the flexible sheet 1111 encompassed by the boundary formed by the interior edges of the peripheral portions 1120*a*, 1120*b*. The peripheral portions 1120*a*, 1120*b* may be comprised of a different material than the material comprising the remainder of the flexible sheet 1111, or the peripheral portions 1120*a*, 1120*b* may have a layer of a material positioned on a surface thereof, or both. In addition, the interior portion 1111*a* may be comprised of a material different from the remainder of the flexible sheet 1111 or may have a layer of material positioned on a surface thereof, or both. Because the flexible sheet 1111 of this embodiment is not segmented, the peripheral portions 1120*a*, 1120*b* may generally extend along one or both edges of the flexible sheet, as illustrated in FIG. 12. The peripheral portions 1120*a*, 1120*b* may extend in a continuous manner, as is the case with peripheral portion 1120*a*, or they may be segmented, as is the case with peripheral portions 1120*b*. The peripheral portions 1120*a*, 1120*b* may have almost any suitable shape or combination of different shapes. Thus, when viewed from various perspectives, the peripheral portions 1120*a*, 1120*b* may be generally and approximately elliptical, triangular, square, rectangular, another polygonal shape, other shapes having arcuate or linear portions, or another shape or combination of such shapes. Thus, where the container contents include food, the flexible sheet 1111 may be constructed of LDPE and the peripheral portions 1120*a*, 1120*b* may have a coating of PVC positioned on the flexible sheet 1111 within the boundaries of the peripheral portions 1120*a*, 1120*b*. The device 1110 may be constructed using substantially any of the methods used to construct the device 1010 described in more detail above and illustrated in conjunction with FIG. 11. In operation, and referring again to the device 1110 of FIG. 12, a separable portion (such as portion 1110*b* of the device 1110) may be removed from the roll 1110*a* by cutting the separable portion 1110*b* from the roll 1110*a* using means well known in the relevant art. The separated portion 1110*b* may be used to operatively seal the opening of the container by positioning at least a part of the interior portion 1111*a* of the flexible sheet 1111 comprising the separated portion 1110*b* over the container opening and then positioning the remainder of the separated portion 1110*b*, which includes the peripheral portions 1120*a*, 1120*b*, against the portions of the container adjacent to the opening.

Figure 13A:
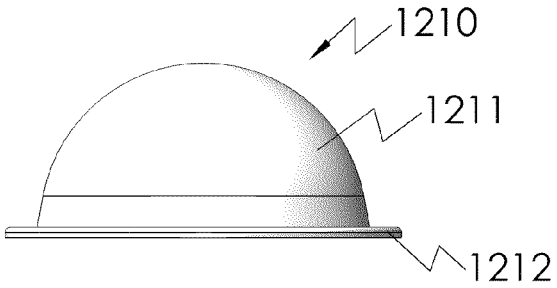
FIG. 13A is an elevation view of yet another embodiment of a device of the present invention, as viewed from the side of the device.
Figure 13B:
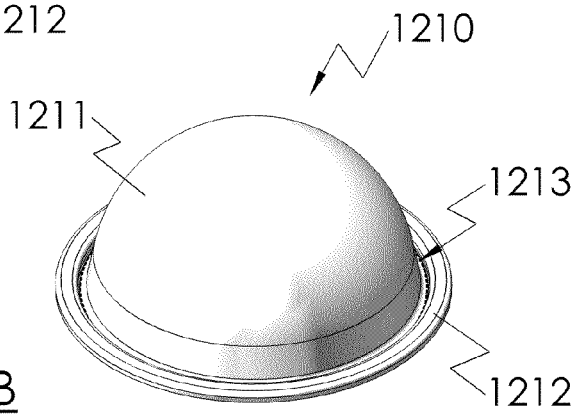
FIG. 13B is a perspective view of the embodiment of the device illustrated in FIG. 13A, as viewed from the side of and above the device.

The device 1210 illustrated in FIG. 13A and FIG. 13B represents yet other embodiment of the present invention. In this embodiment, the device 1210 is comprised of a flexible sheet 1211, perimeter support means (perimeter support member 1212 in this embodiment), and separation means (perforations 1213 in this embodiment). In this embodiment, the flexible sheet 1211 is approximately hemispherical in shape. Otherwise, the device 1210 may generally have any of the same structure, features, characteristics, functions and operation as any embodiments of the devices 10, 110, 210, 310, 410, 510, 610, 710, 810, 910, 1010, 1110 illustrated and described above in more detail in connection with FIG. 1A through FIG. 12B. The device 1210 may be constructed using substantially any of the methods used to construct the any of the devices 10, 110, 210, 310, 410, 610, 710, 810, 910 described in more detail above and illustrated in conjunction with FIG. 1A through FIG. 5B and FIG. 7 through FIG. 10.

It is to be noted that substantially any of the structures, features, characteristics and operation of the various components comprising the embodiments of the devices 10, 110, 210, 310, 410, 510, 610, 710, 810, 910, 1010, 1110, 1210 of the present invention, as described above and illustrated in conjunction with FIG. 1A through FIG. 13B may be utilized in connection with any of the other devices 10, 110, 210, 310, 410, 510, 610, 710, 810, 910, 1010, 1110, 1210 of the present invention in any practical combinations. It is also to be noted that various components comprising the devices 10, 110, 210, 310, 410, 510, 610, 710, 810, 910, 1010, 1110, 1210 of the present invention need not be present in all embodiments of each of the devices 10, 110, 210, 310, 410, 510, 610, 710, 810, 910, 1010, 1110, 1210 of the present invention. For example, and referring to the device 10 illustrated in FIG. 1A through FIG. 1C as an example, the various embodiments of the devices 10, 110, 210, 310, 410, 510, 610, 710, 810, 910, 1010, 1110, 1210 of the present invention may or may not incorporate a perimeter support member 12. Further, it is also to be noted that the multiple-material and multiple-layer composition features, as well as the mechanical sealing means, all as described above and illustrated in conjunction with FIG. 4A through FIG. 5B, FIG. 7 through FIG. 9, and FIG. 11 through FIG. 12, with respect to devices 310, 410, 610, 710, 810, 1010, 1110 are sometimes referred to herein as "supplemental sheet sealing means"as they each relate to enhancing the ability of the separated portion of the flexible sheets 311, 411, 611, 711, 811, 1011, 1111, respectively, to be operatively sealed to the sides (the portion adjacent to the opening) of the container 330, 430 (and not illustrated with respect to devices 610, 710, 810, 1011, 1111), respectively.

What is claimed is:

1. A device for sealing an opening of a container, the device comprising a flexible sheet and a perimeter support member connected to the flexible sheet, wherein a separable portion of the flexible sheet is adapted to be positioned over the opening and to then be separated from the remainder of the device so that the separable portion remains positioned over the opening to operatively seal the opening, and the perimeter support member is a part of the remainder of the device.

2. The device of claim 1, further comprising separation means adapted for operatively separating the separable portion of the flexible sheet from the remainder of the device.

3. The device of claim 2, wherein the separation means are comprised of perforations extending around all or a portion of the perimeter of the separable portion of the flexible sheet.

4. The device of claim 1, further comprising an internal support structure.

5. The device of claim 4, wherein the internal support structure is comprised of a plurality of rigid or semi-rigid members extending along the separable portion of the flexible sheet.

6. The device of claim 1, further comprising supplemental sealing means adapted for enhancing operative sealing of the separable portion of the flexible sheet to the container.

7. The device of claim 1, wherein the separable portion of the flexible sheet has an interior portion and an exterior portion, and the interior portion is comprised of a first material, and the exterior portion extends around all or a portion of the perimeter of the interior portion and is comprised of a second material that is only present in the exterior portion, and the second material is adapted to adhere to itself and to the portions of the container adjacent to the opening.

8. A device adapted to be positioned over a container opening to seal the container opening, the device comprising:

(a) a flexible sheet comprised of a polymer material;

(b) a support member connected to the flexible sheet at approximately the perimeter of the flexible sheet; and (c) separation means adapted for operatively separating a portion of the flexible sheet from the remainder of the device so that the separated portion of the flexible sheet is adapted to seal the container opening.

9. The device of claim 8, wherein the separation means are comprised of perforations extending around all or a portion of the perimeter of the separated portion of the flexible sheet.

10. The device of claim 8, wherein the device is further comprised of folding means for adapting the device to be folded.

11. A method of manufacturing the device of claim 8, the method comprising:

(a) in any order, forming the flexible sheet and forming the support member; and (b) operatively attaching the support member to the flexible sheet.

12. The device of claim 8, further comprising an internal support structure.

13. The device of claim 8, further comprising a layer of material positioned on only a portion of a surface of the flexible sheet.

14. The device of claim 13, wherein the flexible sheet has an interior portion and an exterior portion, and at least a part of the interior portion is adapted to be positioned over and to seal the container opening, and the exterior portion extends around all or a portion of the perimeter of the interior portion, and the layer of material is positioned only on a surface of the exterior portion or only on a surface of the interior portion, of the flexible sheet.

15. A device comprising a flexible sheet and perimeter support means for providing structural support for the flexible sheet, wherein a portion of the flexible sheet is adapted to be positioned over an opening of a container in a manner adapted to seal the container opening, the perimeter support means are adapted to be removed from the portion of the flexible sheet that is positioned over the container opening, and the portion of the flexible sheet positioned over the container opening remains positioned over the container opening upon being removed from the perimeter support means.

16. The device of claim 15, further comprising separation means for operatively separating the portion of the flexible sheet adapted to be positioned over the container opening from the remainder of the device.

17. The device of claim 16, further comprising a layer of material positioned on only a portion of a surface of the flexible sheet.

18. The device of claim 16, wherein the flexible sheet has an interior portion and an exterior portion, and the interior portion is comprised of a first material that is only present in the interior portion, and at least a part of the interior portion is adapted to be positioned over the container opening, and the exterior portion extends around all or a portion of the perimeter of the interior portion and is comprised of a second material.

19. The device of claim 16, wherein the portion of the flexible sheet adapted to be positioned over the container opening is further comprised of an internal support structure.

20. The device of claim 15, wherein the flexible sheet is comprised of a polymer material.

21. The device of claim 8, further comprising mechanical sealing means adapted for assisting the separated portion of the flexible sheet in sealing the container opening.

* * * * *